US010453407B2

(12) United States Patent
Ooishi et al.

(10) Patent No.: US 10,453,407 B2
(45) **Date of Patent: *Oct. 22, 2019**

(54) DISPLAY DEVICE HAVING A RISE TIMING OF A GATE-ON VOLTAGE THAT DIFFERS FROM A RISE TIMING OF A FIRST PULSE SIGNAL

(71) Applicant: Panasonic Liquid Crystal Display Co., Ltd., Hyogo (JP)

(72) Inventors: Yoshihisa Ooishi, Hyogo (JP); Genshiro Kawachi, Hyogo (JP); Kazuo Kita, Hyogo (JP); Toshikazu Koudo, Hyogo (JP); Hideyuki Nakanishi, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/050,874

(22) Filed: Jul. 31, 2018

(65) Prior Publication Data

US 2018/0342218 A1 Nov. 29, 2018

Related U.S. Application Data

(63) Continuation of application No. 15/160,596, filed on May 20, 2016, now Pat. No. 10,147,375, which is a (Continued)

(30) Foreign Application Priority Data

Nov. 21, 2013 (JP) ..... 2013-240998

(51) Int. Cl.
*G09G 3/36* (2006.01)

(52) U.S. Cl.
CPC ..... *G09G 3/3648* (2013.01); *G09G 3/3677* (2013.01); *G09G 2310/0218* (2013.01); (Continued)

(58) Field of Classification Search
CPC ... G09G 2310/0218; G09G 2310/0281; G09G 2310/0297
See application file for complete search history.

(56) References Cited

U.S. PATENT DOCUMENTS 5,151,689 A * 9/1992 Kabuto ..... G02F 1/1345 345/103
6,670,943 B1 12/2003 Ishii et al.
(Continued)

FOREIGN PATENT DOCUMENTS

JP 2-42420 2/1990
JP 2-210323 8/1990
(Continued)

OTHER PUBLICATIONS

International Search Report dated May 20, 2014 in corresponding International Application No. PCT/JP2014/000740.
(Continued)

*Primary Examiner* — Chun-Nan Lin
(74) *Attorney, Agent, or Firm* — Wenderoth, Lind & Ponack, L.L.P.

(57) ABSTRACT

A display apparatus includes an image display region having pixels sectioned by scanning signal lines and video signal lines, scanning connecting lines, thin film transistors, selection signal lines connected to gate electrodes of the thin film transistors, plural ones of the thin film transistors connected to different ones of the scanning connecting lines being connected to one of the selection signal lines; and a scanning signal drive circuit. The scanning signal drive circuit performs a normal scanning mode in which pulse signals are (Continued)

supplied in turn to plural ones of the scanning connecting lines connected to the one of the selection signal lines, and in the normal scanning mode, a fall timing of the gate-on voltage differs from a fall timing of a last one of the pulse signals supplied to the plural ones of the scanning connecting lines during the selection period.

3 Claims, 15 Drawing Sheets

Related U.S. Application Data continuation of application No. PCT/JP2014/000740, filed on Feb. 13, 2014.

(52) U.S. Cl.
CPC ..... *G09G 2310/0281* (2013.01); *G09G 2310/0297* (2013.01); *G09G 2310/067* (2013.01); *G09G 2310/08* (2013.01)

(56) References Cited

U.S. PATENT DOCUMENTS

| | | | | |
|---|---|---|---|---|
| 2001/0003448 | A1* | 6/2001 | Nose | G09G 3/3648 345/99 |
| 2002/0075249 | A1 | 6/2002 | Kubota et al. | |
| 2002/0093495 | A1 | 7/2002 | Akimoto | |
| 2004/0066361 | A1 | 4/2004 | Ishii et al. | |
| 2005/0057459 | A1* | 3/2005 | Miyazawa | G09G 3/3233 345/76 |
| 2005/0243588 | A1 | 11/2005 | Kubota et al. | |
| 2006/0221040 | A1 | 10/2006 | Pak et al. | |
| 2006/0267909 | A1* | 11/2006 | Hsu | G09G 3/3677 345/100 |
| 2007/0146354 | A1 | 6/2007 | Kubota et al. | |
| 2008/0150932 | A1* | 6/2008 | Takahashi | G09G 3/3648 345/214 |
| 2010/0039361 | A1 | 2/2010 | Hsu et al. | |
| 2010/0157189 | A1 | 6/2010 | Ma | |
| 2011/0032284 | A1* | 2/2011 | Owaku | G09G 3/3614 345/690 |
| 2011/0193816 | A1 | 8/2011 | Kitakado | |
| 2011/0227816 | A1 | 9/2011 | Nakamura | |
| 2012/0026420 | A1 | 2/2012 | Saitoh | |
| 2012/0062618 | A1 | 3/2012 | Ono | |
| 2015/0029081 | A1 | 1/2015 | Kawachi et al. | |
| 2016/0240159 | A1 | 8/2016 | Ohkawa | |

FOREIGN PATENT DOCUMENTS

| | | |
|---|---|---|
| JP | 3-31893 | 2/1991 |
| JP | 10-253940 | 9/1998 |
| JP | 2000-227784 | 8/2000 |
| JP | 2001-147418 | 5/2001 |
| JP | 2002-32048 | 1/2002 |
| JP | 2003-29712 | 1/2003 |
| JP | 2006-285233 | 10/2006 |
| JP | 2006-330682 | 12/2006 |
| JP | 2008-77007 | 4/2008 |
| JP | 2009-50118 | 3/2009 |
| JP | 2011-39234 | 2/2011 |
| JP | 2012-32608 | 2/2012 |
| WO | 2013/179537 | 12/2013 |

OTHER PUBLICATIONS

International Search Report dated Feb. 17, 2015 in related International Application No. PCT/JP2014/005659.
International Search Report dated Apr. 8, 2014 in related International Application No. PCT/JP2014/000617.

* cited by examiner

FIG.5B

| Vo | | VG | |
|---|---|---|---|
| | | H | L |
| VCK | H | H | L |
| | L | L | Z |

FIG.10 <NORMAL SCANNING MODE A>

DISPLAY DEVICE HAVING A RISE TIMING OF A GATE-ON VOLTAGE THAT DIFFERS FROM A RISE TIMING OF A FIRST PULSE SIGNAL

CROSS-REFERENCE TO RELATED APPLICATION

This application is a continuation of application Ser. No. 15/160,596, filed May 20, 2016, which is a bypass continuation of international patent application PCT/JP14/000740, filed on Feb. 13, 2014 designating the United States of America, the entire disclosure of which is incorporated herein by reference. Priority is claimed based on Japanese patent application JP2013-240998, filed on Nov. 21, 2013, the entire disclosure of which is incorporated herein by reference in its entirety.

TECHNICAL FIELD

The present disclosure is related to a display device.

BACKGROUND

In a general liquid crystal display apparatus, a drive circuit is provided outside an image display region which is a region where multiple pixels are disposed and an image is formed and displayed. The drive circuit applies signals for controlling the on/off of TFTs (Thin Film Transistors) formed in each pixel to scanning signal lines connected to the gates of the TFTs. A prior art describes a liquid crystal display apparatus in which drive circuits composed of TFTs are disposed on both of the left and right sides of a display region (See Japanese unexamined published patent application No. 2012-32608).

For the display apparatuses, there is a high-resolution demand in which an increase in the number of pixels in the image display region is demanded, and a narrow picture frame demand in which a further reduction in the size of the region outside the image display region is demanded.

Here, when the drive circuits for the scanning signal lines are provided outside the display apparatus like the liquid crystal display apparatus described in the prior art, due to the limitation of a material composing the drive circuits, the drive circuits cannot be miniaturized beyond a certain extent. This fact is remarkable when the material composing the drive circuits is a material having relatively low electron mobility, such as amorphous silicon. Hence, in the configuration in which the drive circuits for the scanning signal lines are provided outside the display apparatus, there is a limitation on narrowing the picture frame. Accordingly, it is difficult to further reduce the width of the picture frame in existing art.

Nevertheless, if the scanning signal lines are individually connected to integrated circuits by wiring lines made of a material with high electrical conduction, e.g., metal, due to achievement of an increase in the resolution of the image display region, the number of scanning signal lines to be connected becomes very large, resulting in an increase in the size of a region where the wiring lines are disposed. Thus, again, it is difficult to reduce the width of the picture frame in existing art.

SUMMARY

The present disclosure is made in view of such circumstances, and an object of the present disclosure is therefore to achieve a narrow picture frame of a display apparatus while the resolution of the display apparatus is maintained.

In one general aspect, the instant application describes a display apparatus includes an image display region having pixels sectioned by scanning signal lines and video signal lines; scanning connecting lines connected to the scanning signal lines, the scanning signal lines being connected to one of the scanning connecting lines; thin film transistors interposed between the scanning signal lines and the scanning connecting lines, a source electrode and a drain electrode of each of the thin film transistors being connected to a corresponding one of the scanning signal lines and a corresponding one of the scanning connecting lines; selection signal lines connected to gate electrodes of the thin film transistors, the thin film transistors connected to different ones of the scanning connecting lines being connected to one of the selection signal lines; and a scanning signal drive circuit connected to the scanning connecting lines and the selection signal lines. The scanning signal drive circuit performs a normal scanning mode in which pulse signals are supplied in turn to plural ones of the scanning connecting lines connected to the one of the selection signal lines, during a selection period in which a gate-on voltage is applied to one of the selection signal lines, gate-off voltages are applied to other ones of the selection signal lines, and in the normal scanning mode, a fall timing of the gate-on voltage differs from a fall timing of a last one of the pulse signals supplied to the scanning connecting lines during the selection period.

In another general aspect, the instant application describes a display apparatus includes an image display region having pixels sectioned by scanning signal lines and video signal lines; scanning connecting lines connected to the scanning signal lines, the scanning signal lines being connected to one of the scanning connecting lines; thin film transistors interposed between the scanning signal lines and the scanning connecting lines, a source electrode and a drain electrode of each of the thin film transistors being connected to a corresponding one of the scanning signal lines and a corresponding one of the scanning connecting lines; selection signal lines connected to gate electrodes of the thin film transistors, the thin film transistors connected to different ones of the scanning connecting lines being connected to one of the selection signal lines; and a scanning signal drive circuit connected to the scanning connecting lines and the selection signal lines. The scanning signal drive circuit performs a normal scanning mode in which pulse signals are supplied in turn to plural ones of the scanning connecting lines connected to the one of the selection signal lines, during a selection period in which a gate-on voltage is applied to one of the selection signal lines, gate-off voltages are applied to other ones of the selection signal lines, and in the normal scanning mode, a rise timing of the gate-on voltage differs from a rise timing of a first one of the pulse signals supplied to the plurality of scanning connecting lines during the selection period.

The object of the present disclosure is therefore to achieve a narrow picture frame of a display apparatus while the resolution of the display apparatus is maintained. A further object of the present disclosure is to suppress an occurrence of display unevenness.

BRIEF DESCRIPTION OF THE DRAWINGS

FIG. 5B is a truth table of the switching elements.

DETAILED DESCRIPTION

Figure 1:
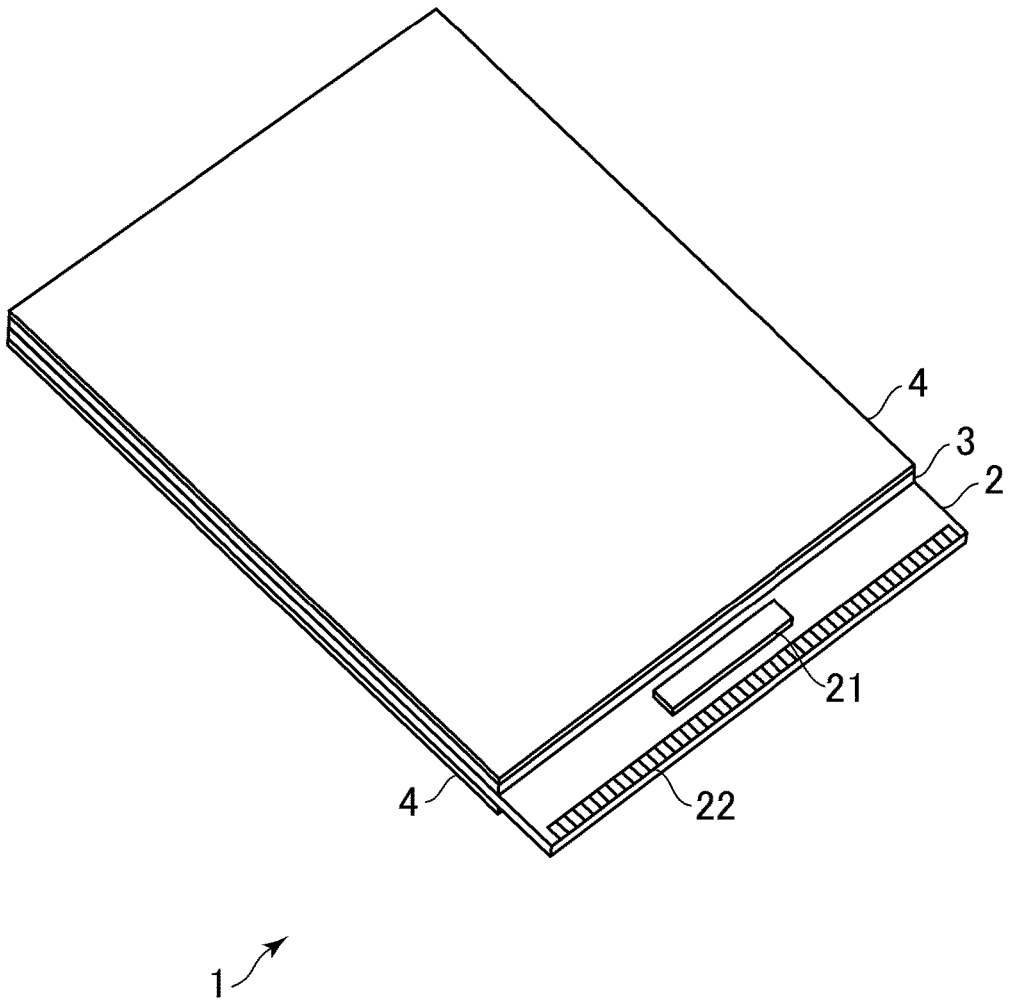
FIG. 1 is an external perspective view of a liquid crystal display apparatus according to an embodiment of the present application.

Exemplary display apparatus are described below with reference to the drawings. In the following embodiments, similar constituent elements are assigned with similar reference numerals. Redundant explanation is omitted as appropriate to clarify the description. Configurations, arrangements and shapes shown in the drawings and description relating to the drawings aim to make principles of the embodiments easily understood. Therefore, the principles of the present embodiments are not limited thereto.

FIG. 1 is an external perspective view of a liquid crystal display apparatus 1 according to an embodiment of the present application. The liquid crystal display apparatus 1 is structured such that a liquid crystal material with a thickness of the order of several micrometers is sandwiched between an array substrate 2 and a color filter substrate 3. A sealing material provided along the periphery of the color filter substrate 3 bonds the array substrate 2 and the color filter substrate 3 together, and seals the liquid crystal display apparatus 1 such that the liquid crystal material does not leak out of the liquid crystal display apparatus 1.

The array substrate 2 is a glass substrate having multiple switching elements and pixel electrodes formed in a grid on the front of the array substrate 2. When thin film transistors (TFTs) are used as the switching elements, the array substrate 2 is also called a TFT substrate. As shown in FIG. 1, the array substrate 2 is larger in outside dimension than the color filter substrate 3, and at least one side of the array substrate 2 protrudes from the color filter substrate 3. Thus, the front of the array substrate 2 is exposed. At the exposed portion of the front of the array substrate 2, there is mounted a driver IC 21 which is a control circuit that controls the on/off of the multiple switching elements and a video signal applied to each pixel electrode, and there is formed a connecting terminal 22 for electrically connecting the liquid crystal display apparatus 1 to, for example, an external device by a flexible wiring board.

The color filter substrate 3 is a glass substrate on which colored thin films colored red, green, and blue are formed on a pixel-by-pixel basis. The pixel is a unit used when the liquid crystal display apparatus 1 forms an image. The colored thin films are provided at positions corresponding to the positions of the pixel electrodes formed on the array substrate 2.

In addition, polarizing films 4 are attached to the back of the array substrate 2 and the front of the color filter substrate 3.

Note that, although in the embodiment described above the liquid crystal display apparatus 1 is of a so-called transmissive type and the array substrate 2 and the color filter substrate 3 are transparent substrates such as glass, when the liquid crystal display apparatus 1 is of a reflective type, the array substrate 2 and the color filter substrate 3 do not necessarily need to be transparent and the material of the array substrate 2 and the color filter substrate 3 is not limited to glass. Note also that although in the embodiment described here the liquid crystal display apparatus 1 can perform full-color display and thus the color filter substrate 3 is provided with red, green and blue colored thin films, a different color combination may be used, or the liquid crystal display apparatus 1 may be allowed to perform monochrome display and accordingly the colored thin films may be monochrome ones or may be omitted.

Figure 2:
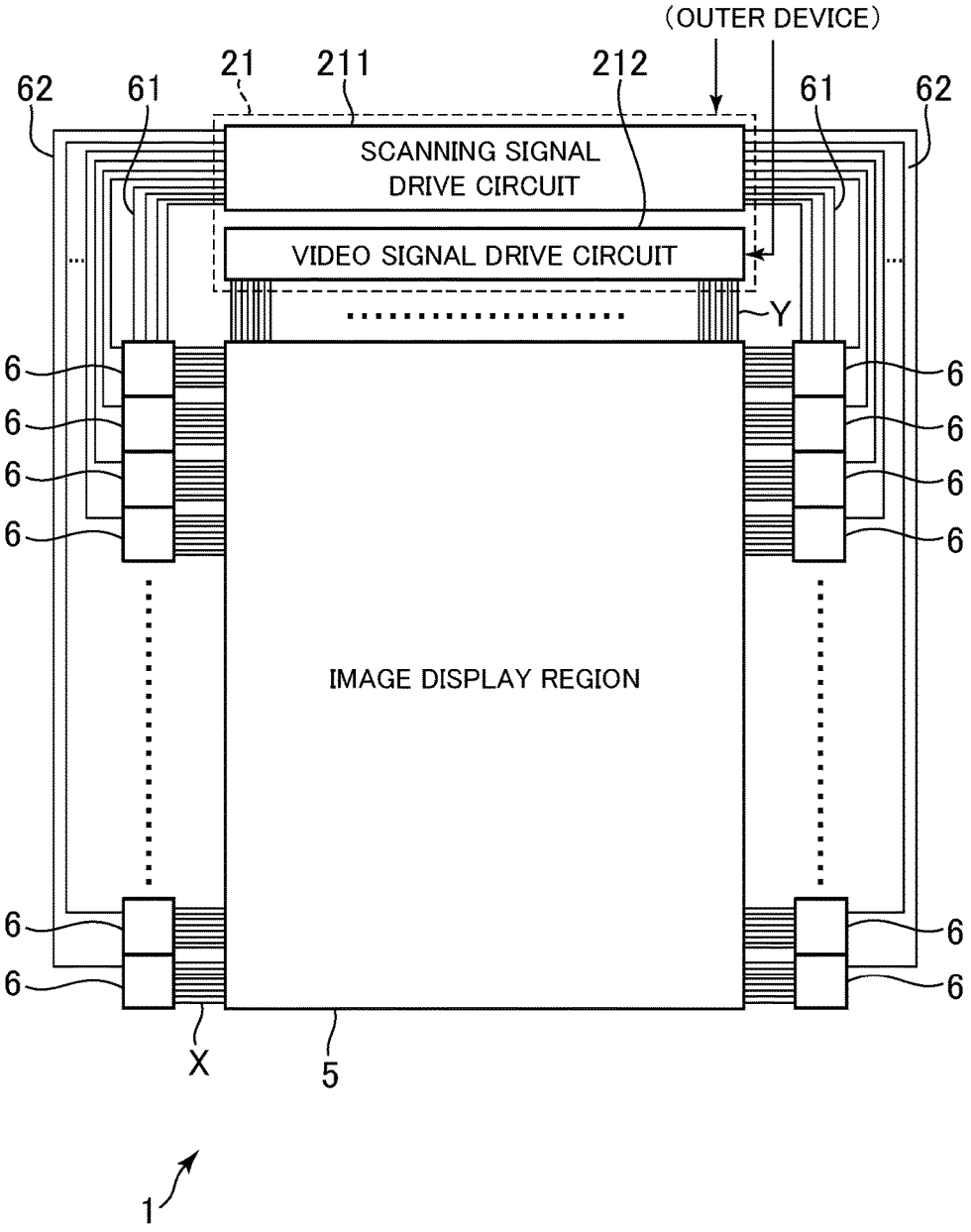
FIG. 2 is a diagram showing the configurations of circuits formed on the array substrate.

FIG. 2 is a diagram showing the configurations of circuits formed on the array substrate 2.

A rectangular image display region 5 is formed on the array substrate 2. In the image display region 5 there are disposed multiple pixels in a grid. Note that the resolution of the image display region 5 and the lengths in the horizontal and vertical directions of the image display region 5 are determined according to the use of the liquid crystal display apparatus 1. The liquid crystal display apparatus 1 exemplified in the present embodiment has a vertically long shape (the length in the horizontal direction is shorter than the length in the vertical direction). This is because the use of the liquid crystal display apparatus 1 is assumed to be as a display apparatus for a personal digital assistant such as a so-called smartphone. Note, however, that depending on the use, the image display region 5 may have a horizontally long shape (the length in the horizontal direction is longer than the length in the vertical direction) or may have equal lengths in the horizontal direction and the vertical direction.

A plurality of scanning signal lines X and a plurality of video signal lines Y are formed on the array substrate 2 so as to pass through the image display region 5. The scanning signal lines X and the video signal lines Y are orthogonal to each other, sectioning the image display region 5 in a grid. A region surrounded by two adjacent scanning signal lines X and two adjacent video signal lines Y forms one pixel.

Figure 3:
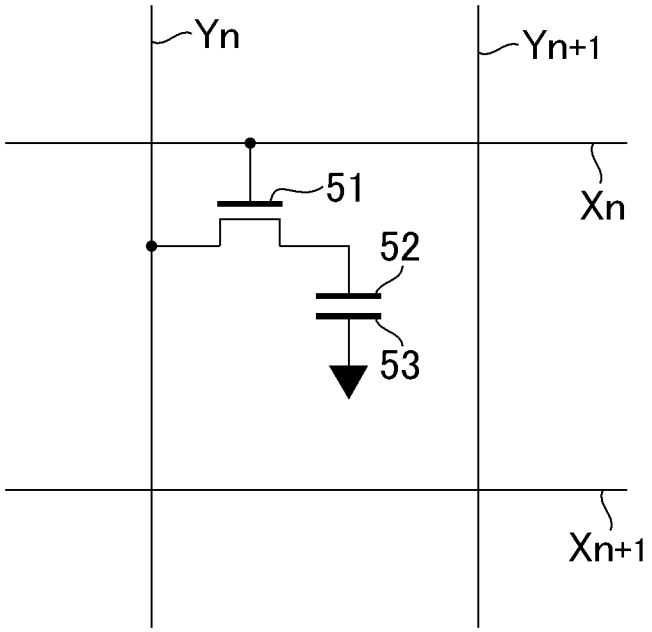
FIG. 3 is a circuit diagram showing one pixel formed in the image display region.

FIG. 3 is a circuit diagram showing one pixel formed in the image display region 5. A region surrounded by scanning signal lines Xn and Xn+1 and video signal lines Yn and Yn+1 which is shown in FIG. 3 forms one pixel. It is assumed that the pixel focused here is driven by the video signal line Yn and the scanning signal line Xn. A TFT 51 is provided in each pixel. The TFT 51 is placed in an on state by a scanning signal which is input from the scanning signal line Xn. The video signal line Yn applies a voltage (a signal indicating a grayscale value of each pixel) to a pixel electrode 52 in the pixel through the TFT 51 being in the on state.

In addition, a common electrode 53 is formed to face the pixel electrode 52 so as to form a capacitance with the pixel electrode 52, with a liquid crystal layer, which is sandwiched and sealed between the array substrate 2 and the color filter substrate 3, present between the common electrode 53 and the pixel electrode 52. The common electrode 53 is electrically connected to a common potential. Hence, an electric field between the pixel electrode 52 and the common electrode 53 changes according to the voltage applied to the pixel electrode 52. Accordingly, the alignment state of a liquid crystal in the liquid crystal layer changes and the polarization state of a light beam transmitting through the image display region 5 is controlled. The transmittance of a light beam transmitting through the liquid crystal display apparatus 1 is determined by the relationship between the polarization direction controlled by the liquid crystal layer and the polarization directions of the polarizing films 4 attached to the array substrate 2 and the color filter substrate 3. Each pixel functions as an element that controls light transmittance. By controlling the light transmittance of each pixel according to input image data, an image is displayed. Therefore, in the liquid crystal display apparatus 1, a region where the pixels are formed serves as the image display region 5 where an image is displayed.

Note that the substrate on which the common electrode 53 is formed varies depending on the liquid crystal drive scheme. In the case of, for example, a scheme called IPS (In Plane Switching), the common electrode 53 is formed on the array substrate 2. In the case of, for example, a scheme called VA (Vertical Alignment) or TN (Twisted Nematic), the common electrode 53 is formed on the color filter substrate 3. Although in the present disclosure the liquid crystal drive scheme is not particularly limited, the IPS scheme is used in the present embodiment.

Referring back to FIG. 2, the driver IC 21 including a scanning signal drive circuit 211 and a video signal drive circuit 212 is provided on at least one of the sides of the image display region 5 parallel to the scanning signal lines X, i.e., the upper side of the image display region 5 in the example shown in FIG. 2. Various types of signals such as a power supply voltage, a ground voltage, a timing signal, and a video signal are input to the driver IC 21 from an external device. Note that in the present embodiment the common potential is the ground potential, but is not necessarily limited to the ground potential.

The scanning signal drive circuit 211 is connected to the scanning signal lines X by a plurality of scanning connecting lines 61, with selection circuits 6 interposed between the scanning signal drive circuit 211 and the scanning signal lines X. In addition, an appropriate number of selection signal lines 62 extend from the scanning signal drive circuit 211 and are connected to the selection circuits 6. The scanning signal drive circuit 211 selects the scanning connecting lines 61 in turn at timings according to a timing signal which is input from the external device, and applies a voltage (hereinafter, referred to as an on-voltage or high-level voltage) that turns on the TFT 51 (see FIG. 3) to the selected scanning connecting line 61. The on-voltage applied to the scanning connecting line 61 is a scanning signal. The selection signal lines 62 are also similar to the scanning connecting lines 61. The scanning signal drive circuit 211 selects the selection signal lines 62 in turn at timings according to a timing signal which is input from the external device, and applies an on-voltage to the selected selection signal line 62. The on-voltage applied to the selection signal line 62 is a selection signal which will be described later. The selection circuits 6 apply on-voltages to the scanning signal lines X in turn based on the on-voltages applied to the scanning connecting lines 61 and the selection signal lines 62. When a voltage is applied to a scanning signal line X, a TFT 51 connected to the scanning signal line X is placed in an on state.

The scanning connecting lines 61, the selection signal lines 62, and the selection circuits 6 are provided on both sides (the left and right sides in the example shown in the figure) of the image display region 5 parallel to the video signal lines Y. Specifically, the scanning connecting lines 61 provided on the left side are connected to the left ends of the scanning signal lines X through the switching elements 63, and the scanning connecting lines 61 provided on the right side are connected to the right ends of the scanning signal lines X through the switching elements 63. An on-voltage can be input from both of the left and right sides. Hence, an alternative use mode is possible, such as using those selection circuits 6 provided on one of the left and right sides to input an on-voltage and allowing those selection circuits 6 on the other side to stop their operation. The scanning connecting lines 61 are disposed such that the scanning connecting lines 61 extend out once from the scanning signal drive circuit 211 to the outside regions in the horizontal direction of the image display region 5 and then pass through the outside regions of the left and right sides of the image display region 5 in a direction parallel to the video signal lines Y and are connected to the selection circuits 6. The selection circuits 6 are arranged between the scanning connecting lines 61 and the image display region 5 and in parallel to the video signal lines Y.

The video signal drive circuit 212 is connected to the video signal lines Y. The video signal drive circuit 212 applies, in accordance with selection of a scanning signal line X by the scanning signal drive circuit 211 and a selection circuit 6, voltages according to video signals indicating the grayscale values of the respective pixels, to TFTs 51 connected to the selected scanning signal line X.

According to the configuration including the scanning connecting lines 61, the selection signal lines 62, and the selection circuits 6, the total number of signal lines to be disposed in the outside regions in the horizontal direction of the image display region 5, i.e., the scanning connecting lines 61 and the selection signal lines 62, significantly decreases. Due to this fact, since the width required for, particularly, the outside regions in the horizontal direction of the image display region 5 becomes small, a narrow picture frame of the liquid crystal display apparatus 1 is achieved.

The relationship between the scanning connecting lines 61, the selection signal lines 62, and the selection circuits 6 will be specifically described below.

Figure 4:
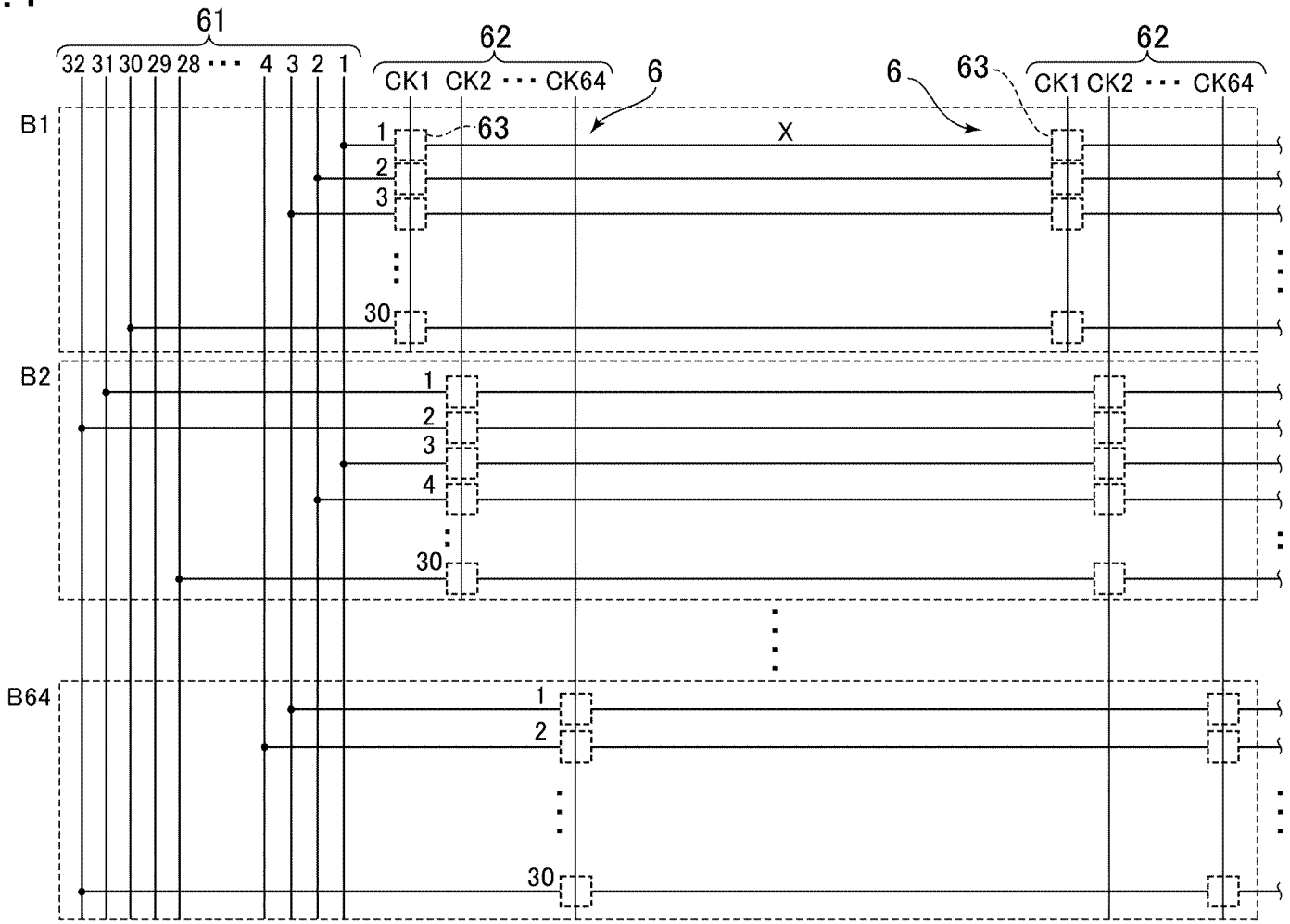
FIG. 4 is a circuit diagram showing the relationship between the scanning connecting lines, the selection signal lines, and the selection circuits.

FIG. 4 is a circuit diagram showing the relationship between the scanning connecting lines 61, the selection signal lines 62, and the selection circuits 6. In FIG. 4, depiction of the scanning connecting lines 61 on the right side is omitted. A plurality of scanning connecting lines 61 are drawn into each selection circuit 6 in a branched manner, and are connected to scanning signal lines X through switching elements 63 composed of TFTs. The switching elements 63 connected to the scanning connecting lines 61 are connected to one of the plurality of selection signal lines 62 in a shared manner. During a selection period in which an on-voltage serving as a selection signal is applied to one of the selection signal lines 62, the scanning signal drive circuit 211 outputs pulse signals serving as scanning signals to the scanning connecting lines 61 in turn.

In the present embodiment, the number of scanning connecting lines 61 is larger by one or more than the number of switching elements 63 connected to one selection signal line 62. In the example of FIG. 4, while there are 32 scanning connecting lines 61, there are 30 switching elements 63 connected to one selection signal line 62. Thus, the number of the scanning connecting lines 61 is larger by two than the number of the switching elements 63 connected to one selection signal line 62.

In the example of FIG. 4, 1920 scanning signal lines X are provided, 32 scanning connecting lines 61 are provided on each of the left and right sides, and 64 selection signal lines 62 are provided on each of the left and right sides. In addition, 64 selection circuits 6, the number of which is the same as the number of the selection signal lines 62, are provided on each of the left and right sides. In each selection circuit 6, 30 switching elements 63 connected to different scanning connecting lines 61 are connected to one selection signal line 62. Numbers 1 to 32 of the scanning connecting lines 61 indicate the order in which a pulse signal is transmitted. Numbers CK1 to CK64 of the selection signal lines 62 indicate the order in which a selection signal is transmitted.

The configurations of the scanning connecting lines 61, the selection signal lines 62, and the selection circuits 6 will be specifically described. The scanning connecting lines 61 with numbers 1 to 30 are drawn into the selection circuit 6 with B1 which is the first one from the top, and are connected to scanning signal lines X through the switching elements 63 with numbers 1 to 30 connected to the selection signal line 62 with CK1. On the other hand, the scanning connecting lines 61 with numbers 31 and 32 are not drawn into the selection circuit 6 with B1, and are not connected to the switching elements 63 with numbers 1 to 30 connected to the selection signal line 62 with CK1.

Next, the scanning connecting lines 61 with numbers 31, 32, and 1 to 28 are drawn into the selection circuit 6 with B2 which is the second one from the top, and are connected to scanning signal lines X through the switching elements 63 with numbers 1 to 30 connected to the selection signal line 62 with CK2. On the other hand, the scanning connecting lines 61 with numbers 29 and 30 are not drawn into the selection circuit 6 with B2, and are not connected to the switching elements 63 with numbers 1 to 30 connected to the selection signal line 62 with CK2. Here, the scanning connecting lines 61 with numbers 31 and 32 which are not connected to the selection circuit 6 with B1 are connected to the switching elements 63 with numbers 1 and 2 which are the first two of the switching elements 63 with numbers 1 to 30 connected to the selection signal line 62 with CK2 in the selection circuit 6 with B2.

For the rest, the same is repeated up to the selection circuit 6 with B64 which is the 64th one from the top. The scanning connecting lines 61 with numbers 3 to 32 are drawn into the selection circuit 6 with B64 which is the 64th one from the top, and are connected to scanning signal lines X through the switching elements 63 with numbers 1 to 30 connected to the selection signal line 62 with CK64. On the other hand, the scanning connecting lines 61 with numbers 1 and 2 are not drawn into the selection circuit 6 with B64, and are not connected to the switching elements 63 with numbers 1 to 30 connected to the selection signal line 62 with CK64. Here, the scanning connecting lines 61 with numbers 3 and 4 which are not connected to the selection circuit 6 with B63 are connected to the switching elements 63 with numbers 1 and 2 which are the first two of the switching elements 63 with numbers 1 to 30 connected to the selection signal line 62 with CK64 in the selection circuit 6 with B64. Note that the selection circuits 6 provided on the right side of the image display region 5 also have the same relationship as that described above.

Note that the numbers of the scanning connecting lines 61, the selection signal lines 62, the switching elements 63, and the selection circuits 6 are not limited to those in the above-described mode. When there are 1600 scanning signal lines X, for example, 32 scanning connecting lines 61 are provided on each of the left and right sides, 64 selection signal lines 62 are provided on each of the left and right sides, and 25 switching elements 63 are connected to one selection signal line 62. In this case, the number of the scanning connecting lines 61 is larger by seven than the number of the switching elements 63 connected to one selection signal line 62. When there are 1280 scanning signal lines X, for example, 22 scanning connecting lines 61 are provided on each of the left and right sides, 64 selection signal lines 62 are provided on each of the left and right sides, and 20 switching elements 63 are connected to one selection signal line 62. In this case, the number of the scanning connecting lines 61 is larger by two than the number of the switching elements 63 connected to one selection signal line 62. When there are 2560 scanning signal lines X, for example, 42 scanning connecting lines 61 are provided on each of the left and right sides, 64 selection signal lines 62 are provided on each of the left and right sides, and 40 switching elements 63 are connected to one selection signal line 62. In this case, the number of the scanning connecting lines 61 is larger by two than the number of the switching elements 63 connected to one selection signal line 62.

The operation of the scanning signal drive circuit 211 will be specifically described. First, the scanning signal drive circuit 211 applies an on-voltage to the selection signal line 62 with CK1 to place all of the switching elements 63 with numbers 1 to 30 connected to the selection signal line 62 with CK1 in an on state, the switching elements 63 being included in the selection circuit 6 with B1 which is the first one from the top. During that period, the scanning signal drive circuit 211 outputs pulse signals in turn to the scanning connecting lines 61 with numbers 1 to 30. Here, the period in which the on-voltage is applied to the selection signal line 62 with CK1 is referred to as a first selection period. In addition, placing all of the switching elements 63 with numbers 1 to 30 connected to the selection signal line 62 with CK1 in an on state, the switching elements 63 being included in the selection circuit 6 with B1, is referred to as placing the selection circuit 6 with B1 in an active state. The pulse signals are, for example, square-wave signals that rise from a low-level voltage to a high-level voltage and then falls from the high-level voltage to the low-level voltage after a lapse of a certain period of time.

Then, the scanning signal drive circuit 211 applies an on-voltage to the selection signal line 62 with CK2 to place all of the switching elements 63 with numbers 1 to 30 connected to the selection signal line 62 with CK2 in an on state, the switching elements 63 being included in the selection circuit 6 with B2 which is the second one from the top. During that period, the scanning signal drive circuit 211 outputs pulse signals in turn to the scanning connecting lines 61 with numbers 31, 32, and 1 to 28. For the rest, the same is repeated up to the selection circuit 6 with B64 which is the 64th one from the top. Finally, the scanning signal drive circuit 211 applies an on-voltage to the selection signal line 62 with CK64 to place all of the switching elements 63 with numbers 1 to 30 connected to the selection signal line 62 with CK64 in an on state, the switching elements 63 being included in the selection circuit 6 with B64 which is the 64th one from the top. During that period, the scanning signal drive circuit 211 outputs pulse signals in turn to the scanning connecting lines 61 with numbers 3 to 32. A specific mode of signals supplied to the scanning connecting lines 61 and the selection signal lines 62 will be described in detail later.

Figure 5A:
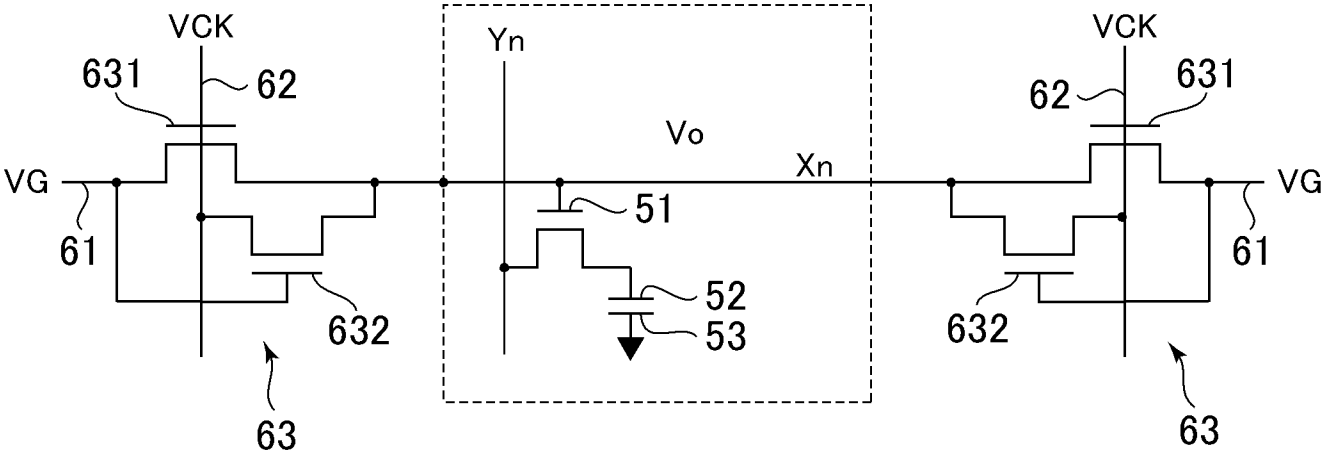
FIG. 5A is a circuit diagram showing switching elements.
Figure 6:
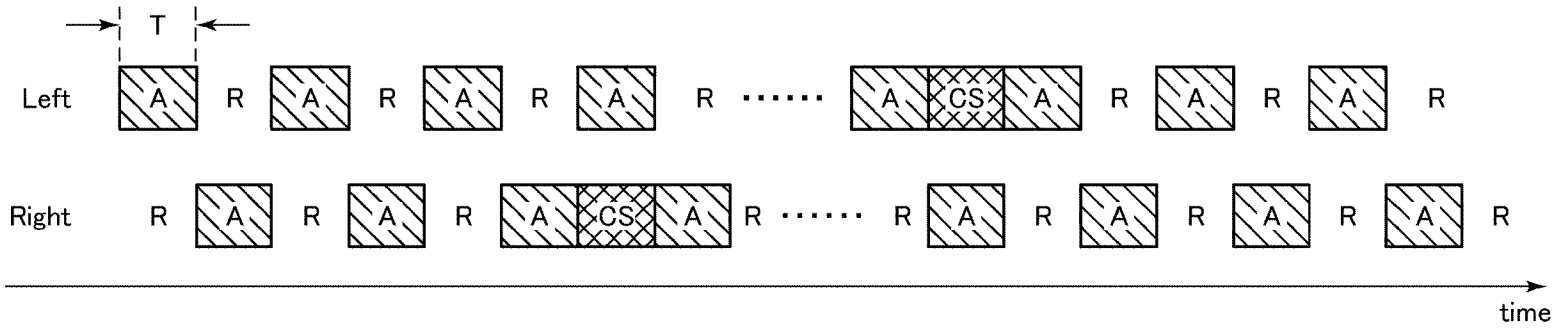
FIG. 6 is a time chart showing the switching of the operating mode of selection circuits.

FIG. 5A is a circuit diagram showing the relationship between scanning connecting lines 61, selection signal lines 62, and switching elements 63. FIG. 5B is a truth table of the switching elements 63. FIG. 6 shows scanning connecting lines 61, selection signal lines 62, and switching elements 63 which are provided on both ends of one scanning signal line Xn.

In the present embodiment, each switching element 63 is composed of two TFTs 631 and 632. Of the two TFTs 631 and 632, the first TFT 631 is connected at its source electrode and drain electrode to the scanning connecting line 61 (VG) and the scanning signal line Xn (V0) and is connected at its gate electrode to the selection signal line 62 (VCK). The second TFT 632 is connected at its source electrode and drain electrode to the selection signal line 62 (VCK) and the scanning signal line Xn (V0) and is connected at its gate electrode to the scanning connecting line 61 (VG).

The switching element 63 configured in this manner outputs a high-level voltage H when a high-level voltage H is applied to the selection signal line 62 (VCK) and a high-level voltage H is applied to the scanning connecting line 61 (VG). In addition, the switching element 63 outputs a low-level voltage L when a high-level voltage H is applied to the selection signal line 62 (VCK) and a low-level voltage L is applied to the scanning connecting line 61 (VG). In addition, the switching element 63 outputs a low-level voltage L when a low-level voltage L is applied to the selection signal line 62 (VCK) and a high-level voltage H is applied to the scanning connecting line 61 (VG). In addition, the switching element 63 is placed in a high-impedance state Z when a low-level voltage L is applied to the selection signal line 62 (VCK) and a low-level voltage L is applied to the scanning connecting line 61 (VG).

FIG. 6 is a time chart showing the switching of the operating mode of selection circuits 6. The top of FIG. 6 shows the operating mode performed by a selection circuit 6 provided on the left side, and the bottom of FIG. 6 shows the operating mode performed by a selection circuit 6 provided on the right side. The letter "A" in FIG. 6 indicates a normal scanning mode, the letter "R" indicates a reset mode, and the letters "CS" indicate a counter stress mode.

The scanning signal drive circuit 211 performs a normal scanning mode A in which a scanning signal line X is scanned, on one of two sets of a scanning connecting line 61, a selection signal line 62, and a selection circuit 6 which are provided on both of the left and right sides, and performs a reset mode R in which the scanning signal line X is not scanned, on the other set. In addition, the scanning signal drive circuit 211 switches between the normal scanning mode A and the reset mode R every fixed period T (e.g., on the order of 0.1 seconds to several seconds).

In the normal scanning mode, as described above, during a selection period in which an on-voltage is applied to one selection signal line 62, the scanning signal drive circuit 211 outputs pulse signals in turn to the scanning connecting lines 61. In the reset mode, the scanning signal drive circuit 211 applies an off-voltage to one selection signal line 62, applies on-voltages to other selection signal lines 62, and applies low-level voltages to the scanning connecting lines 61.

Furthermore, the scanning signal drive circuit 211 performs, instead of the reset mode R, a counter stress mode CS in which counter stresses are applied to the switching elements 63 included in the selection circuit 6, at a fixed rate (e.g., on the order of 1 in every 1000 reset modes R).

Here, applying the counter stresses to the switching elements 63 refers to applying a low-level voltage (e.g., −6 V) to a selection signal line 62 connected to the gate electrodes of the switching elements 63 and applying high-level voltages (e.g., 18 V) to scanning connecting lines 61 connected to the source electrodes or drain electrodes of the switching elements 63.

The switching elements 63 included in each selection circuit 6 have a higher frequency of use than the TFTs 51 included in the pixels (see FIG. 3). Hence, when amorphous silicon, for example, is used as the switching elements 63, the amorphous silicon contained in the switching elements 63 may degrade with the accumulation of the use period of the liquid crystal display apparatus 1 (the display period for displaying images on the image display region 5) and thus the threshold voltage of the switching elements 63 may gradually increase.

In view of this, in the present embodiment, by applying counter stresses to the switching elements 63 included in the selection circuits 6, an increase in the threshold voltage of the switching elements 63 is suppressed, achieving a long life of the liquid crystal display apparatus 1.

Figure 7:
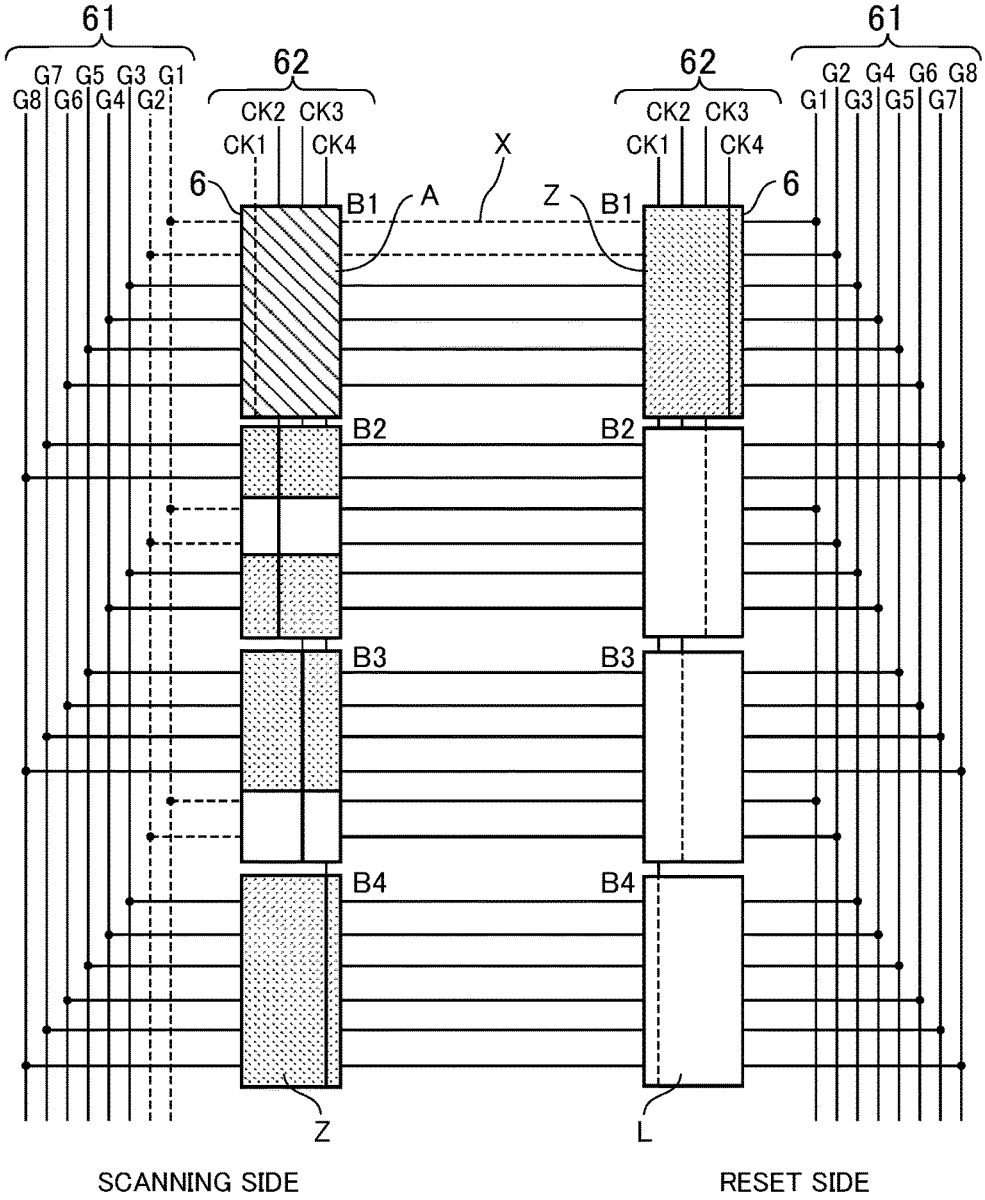
FIG. 7 is a circuit diagram to explain the operating mode of selection circuits.
Figure 8:
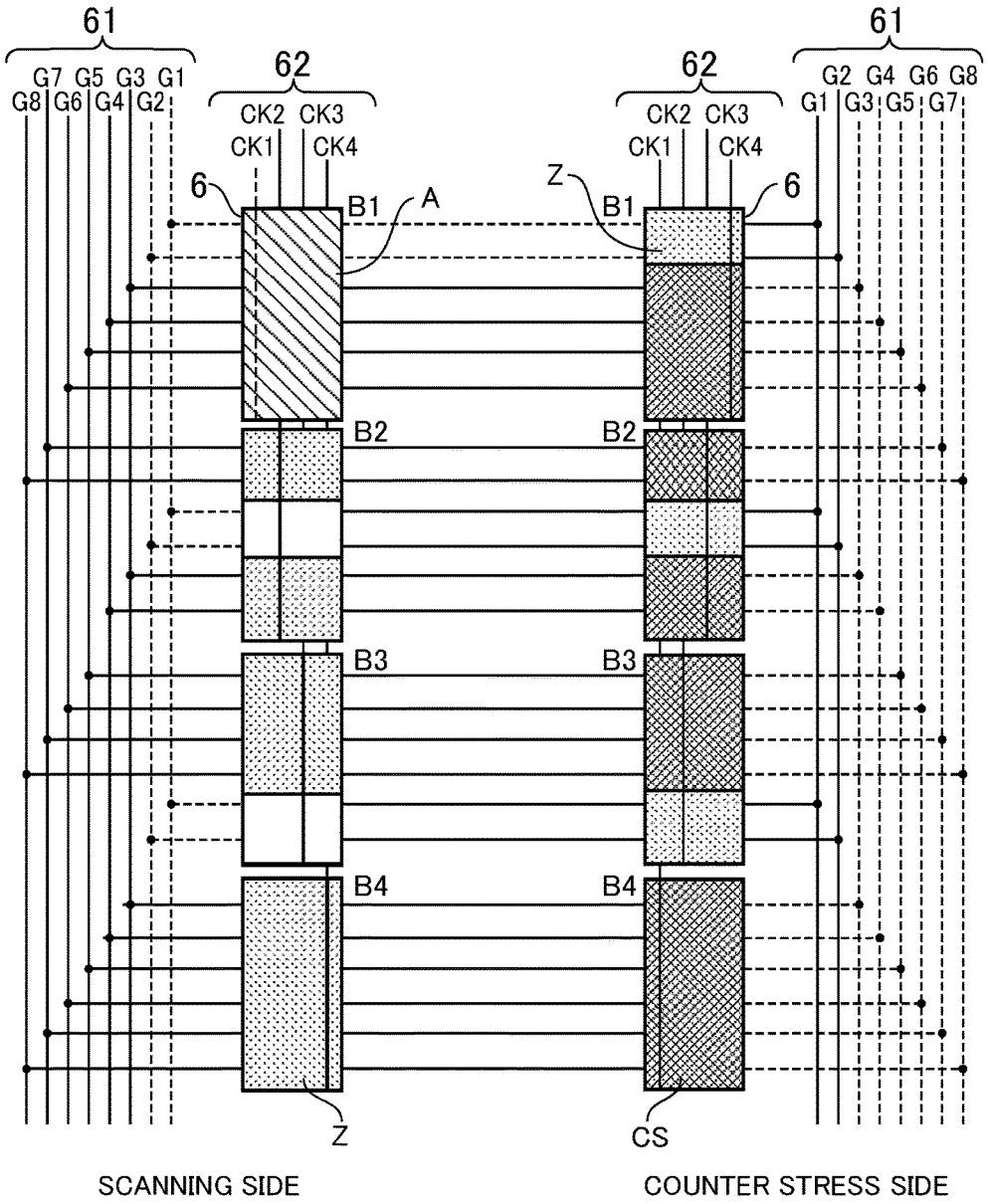
FIG. 8 is a circuit diagram to explain the operating mode of selection circuits.

FIGS. 7 and 8 are diagrams for describing the operating mode of the selection circuits 6. In the examples shown in FIGS. 7 and 8, 8 scanning connecting lines 61 are provided on each of the left and right sides, four selection signal lines 62 are provided on each of the left and right sides, and four selection circuits 6 are provided on each of the left and right sides. Six scanning connecting lines 61 are drawn into each selection circuit 6. In addition, in the examples shown in FIGS. 7 and 8, of the scanning connecting lines 61 with G1 to G8 and the selection signal lines 62 with CK1 to CK4, those lines to which high-level voltages are applied are indicated by dashed lines. The examples shown in FIGS. 7 and 8 show the state of the moment when pulse signals are output to the scanning connecting lines 61 with G1 and G2 on the left side.

In the example of FIG. 7, a normal scanning mode is performed on the left side written as "scanning side", and a reset mode is performed on the right side written as "reset side". In addition, in the example of FIG. 7, a selection circuit 6 that is placed in an active state by the application of a high-level voltage to a corresponding selection signal line 62 is hatched and given the letter "A". Of other selection circuits 6, a portion that outputs a low-level voltage is outlined and given the letter "L", and a portion that is placed in a high-impedance state is provided with a dot pattern and given the letter "Z".

Specifically, during a first selection period, the scanning signal drive circuit 211 applies a high-level voltage to the selection signal line 62 with CK1 on the left side that performs the normal scanning mode, applies low-level voltages to the selection signal lines 62 with CK2 to CK4 on the left side, and outputs pulse signals in turn to the scanning connecting lines 61 with G1 to G8 on the left side. By this, the selection circuit 6 with B1 on the left side is placed in an active state. The selection circuits 6 with B2 to B4 on the left side are basically placed in a high-impedance state, but those portions to which pulse signals are supplied from the scanning connecting lines 61 are temporarily placed in a state of outputting low-level voltages.

In addition, during the first selection period, the scanning signal drive circuit 211 applies a low-level voltage to the selection signal line 62 with CK4 on the right side that corresponds to the selection signal line 62 with CK1 on the left side among the selection signal lines 62 with CK1 to CK4 on the right side that performs the reset mode, applies high-level voltages to the selection signal lines 62 with CK1 to CK3 on the right side that do not correspond to the selection signal line 62 with CK1 on the left side, and applies low-level voltages to all of the scanning connecting lines 61 with G1 to G8 on the right side. By this, the selection circuit 6 with B1 on the right side is placed in a high-impedance state, and the selection circuits 6 with B2 to B4 on the right side are placed in a state of outputting low-level voltages. By this, those scanning signal lines X connected to the selection circuits 6 with B2 to B4 on the right side are not placed in a floating state and are maintained at the low-level voltage.

Also during a second selection period, a third selection period, and a fourth selection period, such operation is performed in the same manner.

In the example of FIG. 8, a normal scanning mode is performed on the left side written as "scanning side", and a counter stress mode is performed on the right side written as "counter stress side". In addition, in the example of FIG. 8, a selection circuit 6 that is placed in an active state by the application of a high-level voltage to a corresponding selection signal line 62 is hatched and given the letter "A". Of other selection circuits 6, a portion to which a counter stress is applied is cross-hatched and given the letters "CS", and a portion that is placed in a high-impedance state is provided with a dot pattern and given the letter "Z".

Specifically, as described above, during a first selection period, the scanning signal drive circuit 211 applies a high-level voltage to the selection signal line 62 with CK1 on the left side that performs the normal scanning mode, applies low-level voltages to the selection signal lines 62 with CK2 to CK4 on the left side, and outputs pulse signals in turn to the scanning connecting lines 61 with G1 to G8 on the left side.

In addition, during the first selection period, the scanning signal drive circuit 211 applies low-level voltages to the selection signal lines 62 with CK1 to CK4 on the right side that performs the counter stress mode, and applies high-level voltages to the scanning connecting lines 61 with G1 to G8 on the right side. That is, counter stresses are applied to the selection circuits 6 with B1 to B4 on the right side. In the present embodiment, when counter stresses are applied to the selection circuits 6 with B1 to B4 on the right side, the selection circuits 6 with B1 to B4 on the right side are placed in a state of outputting low-level voltages (see FIG. 5B). By this, the scanning signal lines X are not placed in a floating state and are maintained at the low-level voltage.

Furthermore, the scanning signal drive circuit 211 outputs pulse signals in turn to the scanning connecting lines 61 with G1 to G8 on the left side that performs the normal scanning mode. Meanwhile, the voltages applied to the scanning connecting lines 61 with G1 to G8 on the right side that performs the counter stress mode are temporarily switched from a high-level voltage to a low-level voltage in accordance with the timings of outputting the pulse signals. Thus, the switching elements 63 are temporarily placed in a high-impedance state Z. That is, the scanning signal drive circuit 211 outputs signals with an opposite phase (opposite pulse signals) to the pulse signals output to the scanning connecting lines 61 with G1 to G8 on the left side that performs the normal scanning mode, to the scanning connecting lines 61 with G1 to G8 on the right side that performs the counter stress mode.

Also during a second selection period, a third selection period, and a fourth selection period, such operation is performed in the same manner.

Figure 9:
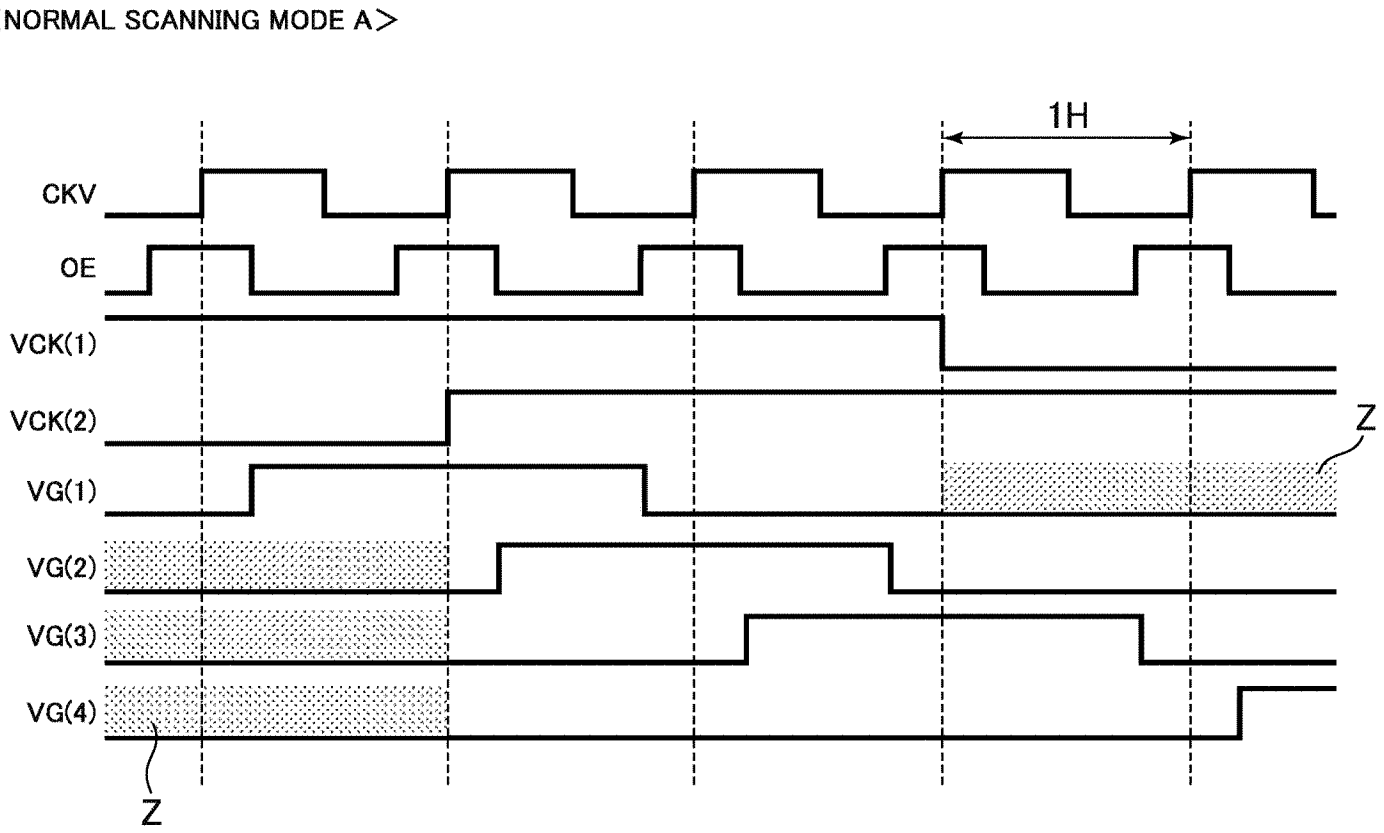
FIG. 9 is a timing chart showing signals supplied in the normal scanning mode.

FIG. 9 is a timing chart showing signals supplied in the normal scanning mode. FIG. 9 shows a boundary portion between a first selection period in which an on-voltage is applied to the selection signal line 62 with CK1 and a second selection period in which an on-voltage is applied to the selection signal line 62 with CK2. CKV indicates a clock signal and OE indicates an enable signal. VCK(n) indicates a selection signal supplied to a selection signal line 62, and VG(n) indicates a pulse signal supplied to a scanning connecting line 61. In addition, a dot-pattern area in FIG. 9 indicates a high-impedance state.

Figure 10:
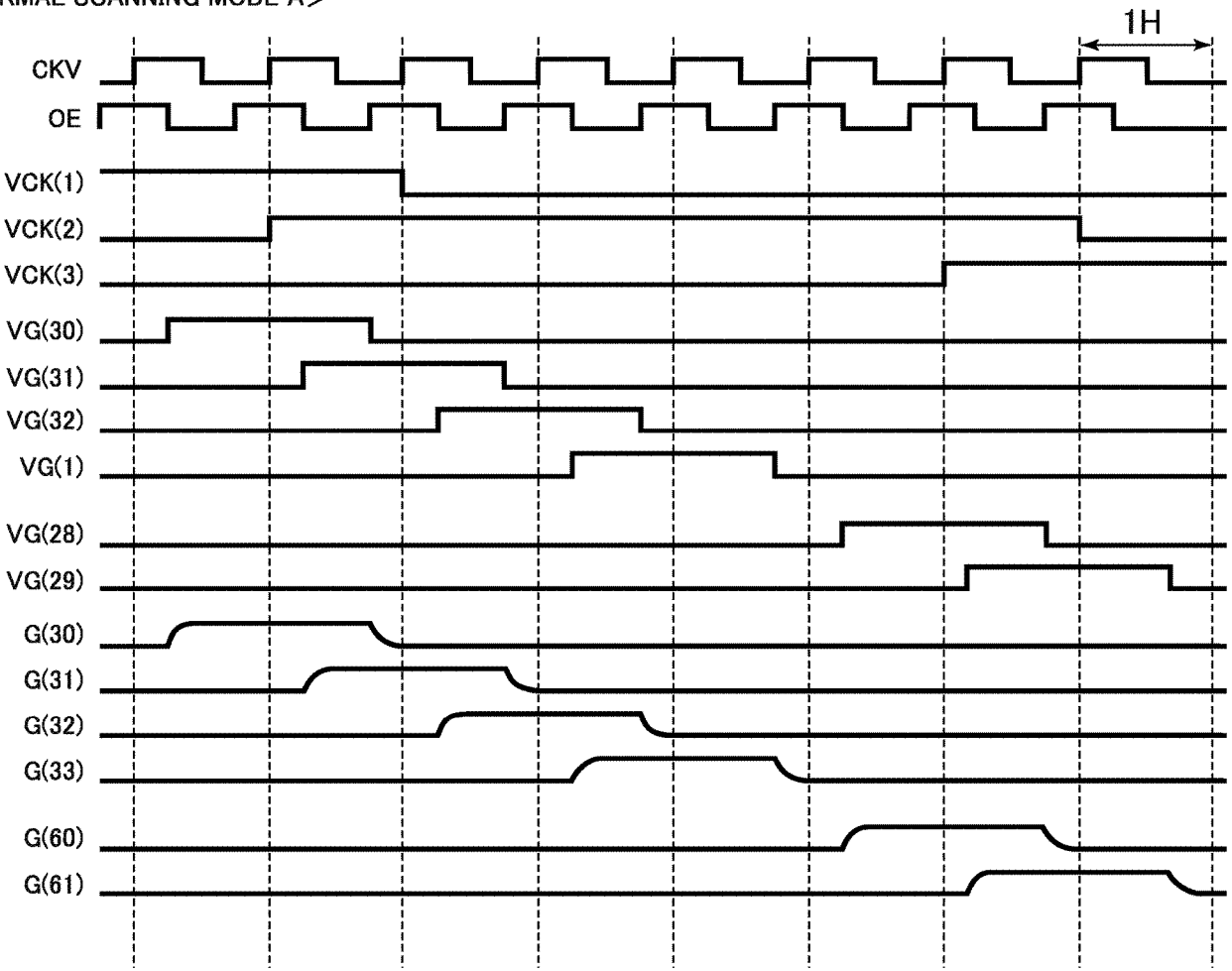
FIG. 10 is a timing chart showing signals supplied in the normal scanning mode.

Furthermore, FIG. 10 shows a signal G(n) actually supplied to a scanning signal line X, in addition to signals supplied to scanning connecting lines 61 and selection signal lines 62. The signal G(n) actually supplied to the scanning signal line X is a pulse signal which is supplied to a corresponding scanning connecting line 61 and whose signal waveform is blunt as a result of passing through a switching element 63, etc.

When, for example, the timing at which a selection signal VCK(n) supplied to a selection signal line 62 falls from a high-level voltage to a low-level voltage coincides with the timing at which a pulse signal VG(n) supplied to a scanning connecting line 61 falls from a high-level voltage to a low-level voltage, the signal waveform of a signal G(n) actually supplied to a scanning signal line X becomes different from other signal waveforms. Thus, a horizontal line may run on an image displayed, and accordingly, display unevenness may occur.

In view of this, in the present embodiment, as shown in FIGS. 9 and 10, the timing at which the voltage of the selection signal VCK(n) supplied to the selection signal line 62 is switched is made different from the timing at which the voltage of the pulse signal VG(n) supplied to the scanning connecting line 61 is switched. Thus, the occurrence of display unevenness is suppressed.

Specifically, the scanning signal drive circuit 211 controls the rise and fall of the selection signals VCK(n) supplied to the selection signal lines 62, based on the clock signal CKV, and controls the rise and fall of the pulse signals VG(n) supplied to the scanning connecting lines 61, based on the enable signal OE. One cycle of the clock signal CKV is one horizontal scanning cycle (1H). The enable signal OE is a signal having the same cycle as the clock signal CKV and having rise and fall timings different from those of the clock signal CKV. In the present embodiment, the enable signal OE is shifted by one-quarter cycle relative to the clock signal CKV.

As a result, the timing at which the selection signal VCK(n) supplied to the selection signal line 62 falls from a high-level voltage to a low-level voltage differs from the timing at which the pulse signal VG(n) supplied to the scanning connecting line 61 falls from a high-level voltage to a low-level voltage. In the example of FIG. 9, the pulse signal VG(2) falls from a high-level voltage to a low-level voltage before the selection signal VCK(1) falls from a high-level voltage to a low-level voltage. In addition, in the example of FIG. 10, the pulse signal VG(30) falls from a high-level voltage to a low-level voltage before the selection signal VCK(1) falls from a high-level voltage to a low-level voltage.

In addition, the timing at which the selection signal VCK(n) supplied to the selection signal line 62 rises from a low-level voltage to a high-level voltage differs from the timing at which the pulse signal VG(n) supplied to the scanning connecting line 61 rises from a low-level voltage to a high-level voltage. In the example of FIG. 9, the pulse signal VG(2) rises from a low-level voltage to a high-level voltage after the selection signal VCK(2) rises from a low-level voltage to a high-level voltage. In addition, in the example of FIG. 10, the pulse signal VG(31) rises from a low-level voltage to a high-level voltage after the selection signal VCK(2) rises from a low-level voltage to a high-level voltage.

Note that, as shown in FIG. 10, in the present embodiment the scanning signal drive circuit 211 makes the duration of pulse signals which are output in turn to the scanning connecting lines 61 with numbers 1 to 32 longer than one horizontal scanning cycle (1H), and allows the pulse signals to temporally overlap each other such that before a previous pulse signal falls, the next pulse signal rises. The duration of the pulse signals is 1.5 H, for example. In addition, the scanning signal drive circuit 211 makes the rise timing of a pulse signal which is output to a scanning connecting line 61 earlier than the supply start timing at which a video signal voltage corresponding to a pixel value is supplied from a video signal line Y to a TFT 51 in a pixel (see FIG. 3) provided for the scanning connecting line 61. By this, even if one horizontal scanning cycle (1H) is reduced with an increase in the resolution of the image display region 5, pixel charging time can be secured. In particular, when, as in the present embodiment, the switching elements 63 composed of TFTs are used, the rise and fall of pulse signals for driving the TFTs 51 in the image display region 5 is likely to become slowed due to the influence of the on-resistance of the switching elements 63. Thus, it is important to secure pixel charging time by making the duration of the pulse signals longer than 1H.

In addition, in the present embodiment, the scanning signal drive circuit 211 starts a second selection period in which an on-voltage is applied to the selection signal line 62 with CK2, 1H before the first selection period in which an on-voltage is applied to the selection signal line 62 with CK1 ends, and outputs a pulse signal to the scanning connecting line 61 with number 31 which is not connected to any of the switching elements 63 connected to the selection signal line 62 with CK1. That is, the scanning signal drive circuit 211 starts the second selection period in which the selection circuit 6 with B2 is placed in an active state, 1H before the first selection period in which the selection circuit 6 with B1 is placed in an active state ends, and outputs a pulse signal to the scanning connecting line 61 with number 31 which is not connected to the selection circuit 6 with B1. According to this, even if on-voltages are simultaneously applied to the selection signal lines 62 with CK1 and CK2, a pulse signal that is output to the scanning connecting line 61 with number 31 does not flow into the selection circuit 6 with B1 and does not exert an influence on a corresponding scanning signal line X. Hence, by supplying, before the first selection period ends, a pulse signal to the scanning connecting line 61 with number 31 which is the first one in the second selection period, the duration of the pulse signal can be made longer than 1H as described above.

Figure 11:
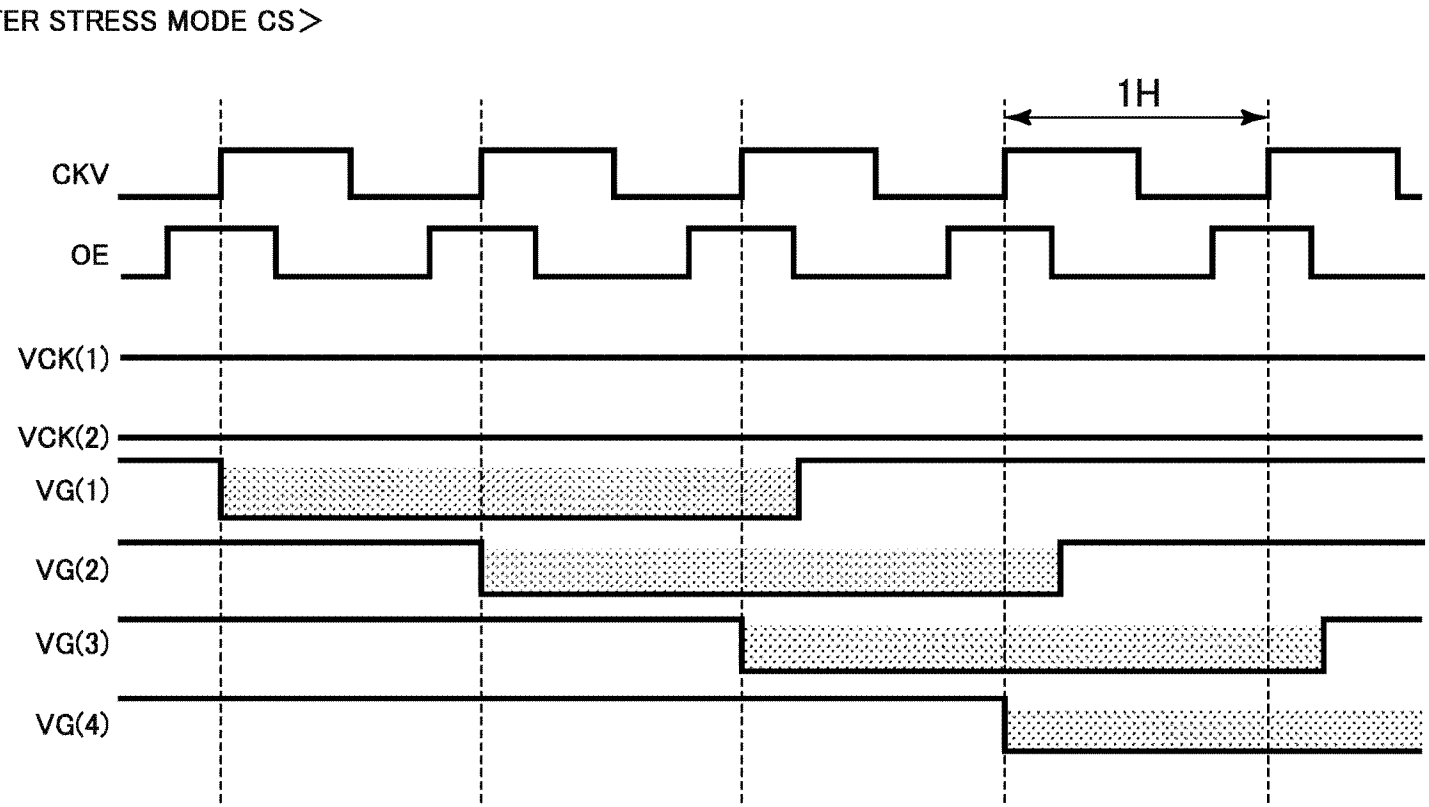
FIG. 11 is a timing chart showing signals supplied in the counter stress mode.

FIG. 11 is a timing chart showing signals supplied in the counter stress mode. CKV indicates a clock signal and OE indicates an enable signal. VCK(n) indicates a selection signal supplied to a selection signal line 62, and VG(n) indicates an opposite pulse signal supplied to a scanning connecting line 61. In addition, a dot-pattern area in FIG. 11 indicates a high-impedance state.

In the present embodiment, as shown in FIG. 11, the timing at which an opposite pulse signal VG(n) supplied to one scanning connecting line 61 falls from a high-level voltage to a low-level voltage is made different from the timings at which opposite pulse signals VG(n) supplied to other scanning connecting lines 61 rise from a low-level voltage to a high-level voltage.

Specifically, the scanning signal drive circuit 211 controls the fall of the opposite pulse signals VG(n) supplied to the scanning connecting lines 61, based on the clock signal CKV, and controls the rise of the opposite pulse signals VG(n) supplied to the scanning connecting lines 61, based on the enable signal OE. In the example of FIG. 11, the opposite pulse signal VG(1) rises from a low-level voltage to a high-level voltage after the opposite pulse signal VG(3) falls from a high-level voltage to a low-level voltage.

Figure 12:
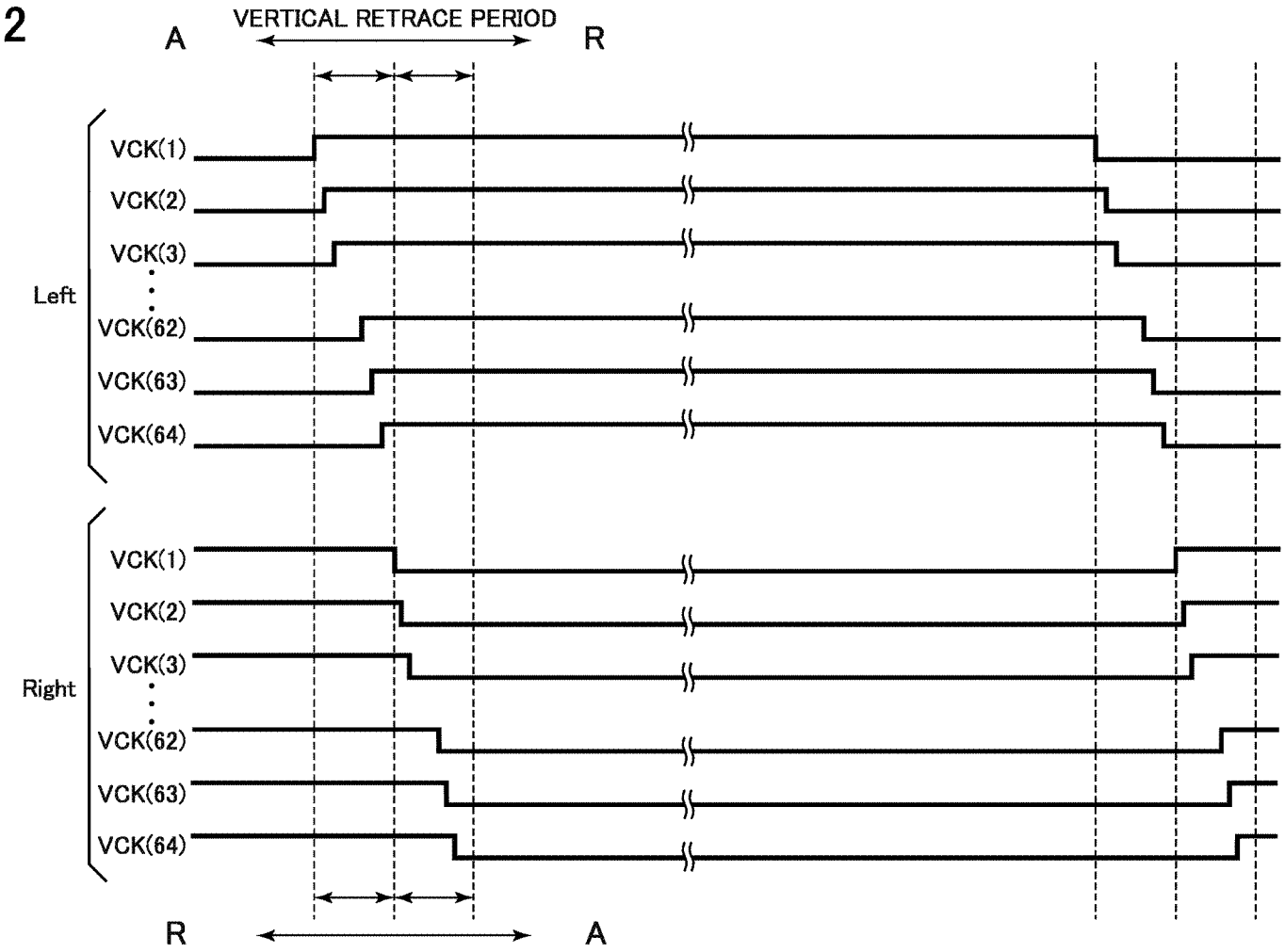
FIG. 12 is a timing chart showing the switching of voltages during a vertical retrace period.
Figure 13:
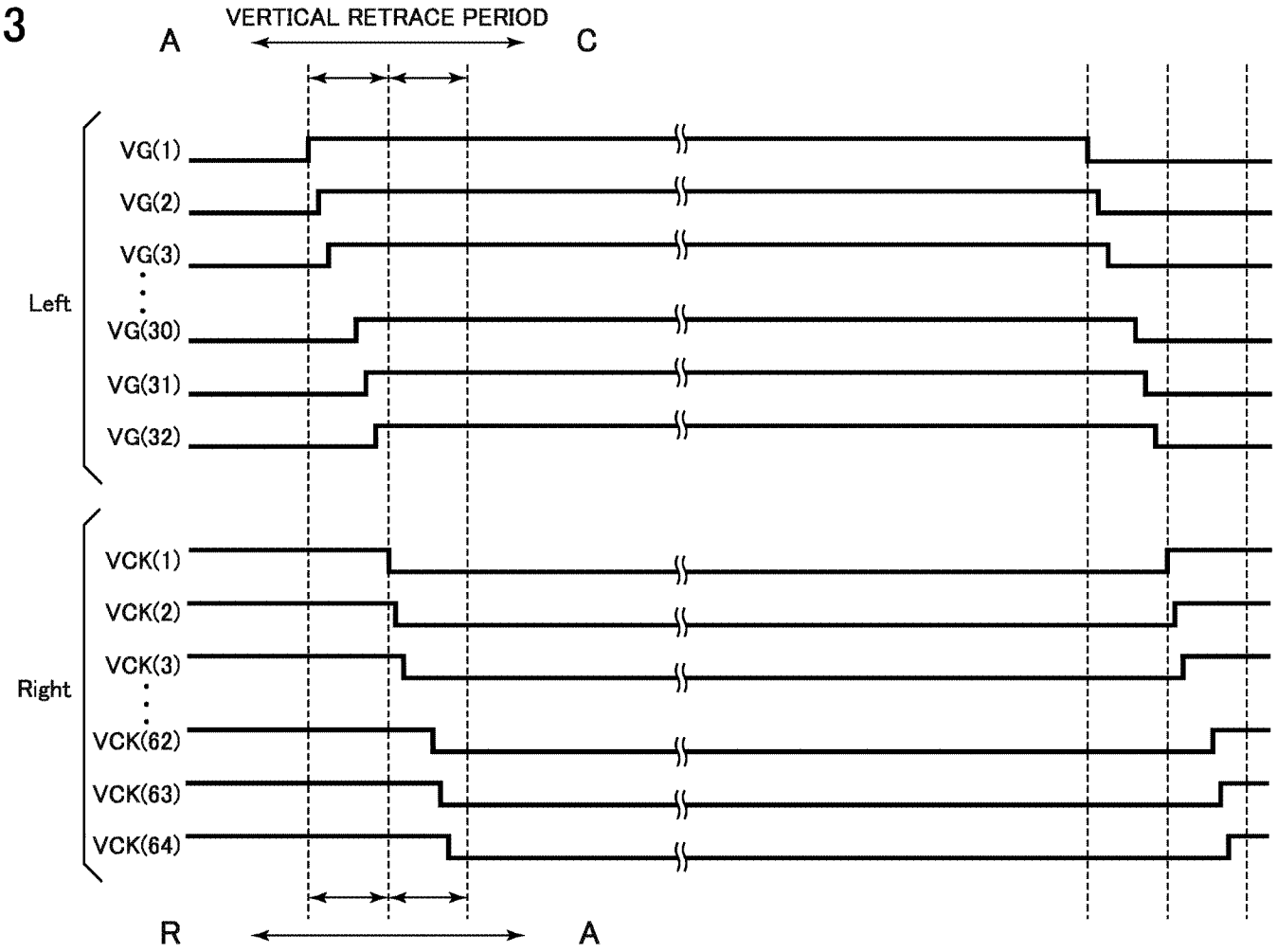
FIG. 13 is a timing chart showing the switching of voltages during a vertical retrace period.

FIGS. 12 and 13 are timing charts showing the switching of voltages during a vertical retrace period. The top of FIG. 12 shows the switching side from the normal scanning mode A to the reset mode R, and the bottom of FIG. 12 shows the switching side from the reset mode R to the normal scanning mode A. The top of FIG. 13 shows the switching side from the normal scanning mode A to the counter stress mode CS, and the bottom of FIG. 13 shows the switching side from the reset mode R to the normal scanning mode A.

As described above, in the normal scanning mode, low-level voltages are basically applied to the plurality of selection signal lines 62, and a high-level voltage is applied as a selection signal to one selection signal line 62 selected from among the plurality of selection signal lines 62. On the other hand, in the reset mode, high-level voltages are basically applied to the plurality of selection signal lines 62, and a low-level voltage is applied to one selection signal line 62 selected from among the plurality of selection signal lines 62. Hence, when switching between the normal scanning mode and the reset mode is performed, the voltages applied to the plurality of selection signal lines 62 need to be switched.

In addition, in the normal scanning mode, low-level voltages are basically applied to the plurality of scanning connecting lines 61, and high-level voltages are applied in turn, as pulse signals, to the plurality of scanning connecting line 61. On the other hand, in the counter stress mode, high-level voltages are basically applied to the plurality of scanning connecting lines 61, and low-level voltages are applied in turn, as opposite pulse signals, to the plurality of scanning connecting line 61. Hence, when switching between the normal scanning mode and the counter stress mode is performed, the voltages applied to the plurality of scanning connecting lines 61 need to be switched.

Meanwhile, when the voltages applied to the scanning connecting lines 61 and the selection signal lines 62 are switched all at once, an overcurrent may flow through a power supply path.

In view of this, in the present embodiment, as shown in FIGS. 12 and 13, when the mode is switched during a vertical scanning retrace period, the timings at which the voltages are switched are made different from each other. Thus, an overcurrent is suppressed.

Specifically, as shown in the top of FIG. 12, when the scanning signal drive circuit 211 switches from the normal scanning mode to the reset mode, the scanning signal drive circuit 211 switches voltages VCK(1) to VCK(64) applied to the selection signal lines 62 with numbers 1 to 64 from a low-level voltage to a high-level voltage in turn. In addition, as shown in the bottom of FIG. 12, when the scanning signal drive circuit 211 switches from the reset mode to the normal scanning mode, the scanning signal drive circuit 211 switches the voltages VCK(1) to VCK(64) applied to the selection signal lines 62 with numbers 1 to 64 from a high-level voltage to a low-level voltage in turn.

In addition, as shown in the entire FIG. 12, during a first period included in the vertical scanning retrace period, the scanning signal drive circuit 211 switches the voltages VCK(1) to VCK(64) applied to the selection signal lines 62 with numbers 1 to 64 on one side (e.g., the left side) from a low-level voltage to a high-level voltage in turn, and during a second period included in the vertical scanning retrace period, the scanning signal drive circuit 211 switches the voltages VCK(1) to VCK(64) applied to the selection signal lines 62 with numbers 1 to 64 on the other side (e.g., the right side) from a high-level voltage to a low-level voltage in turn.

In addition, as shown in the top of FIG. 13, when the scanning signal drive circuit 211 switches from the normal scanning mode to the counter stress mode, the scanning signal drive circuit 211 switches voltages VG(1) to VG(32) applied to the scanning connecting lines 61 with numbers 1 to 32 from a low-level voltage to a high-level voltage in turn. In addition, also when the scanning signal drive circuit 211 switches from the counter stress mode to the normal scanning mode, likewise, the scanning signal drive circuit 211 switches the voltages VG(1) to VG(32) applied to the scanning connecting lines 61 with numbers 1 to 32 from a high-level voltage to a low-level voltage in turn.

In addition, as shown in the entire FIG. 13, during a first period included in the vertical scanning retrace period, the scanning signal drive circuit 211 switches the voltages VG(1) to VG(32) applied to the scanning connecting lines 61 with numbers 1 to 32 on one side (e.g., the left side) from a low-level voltage to a high-level voltage in turn, and during a second period included in the vertical scanning retrace period, the scanning signal drive circuit 211 switches the voltages VG(1) to VG(32) applied to the scanning connecting lines 61 with numbers 1 to 32 on the other side (e.g., the right side) from a high-level voltage to a low-level voltage in turn.

Figure 14:
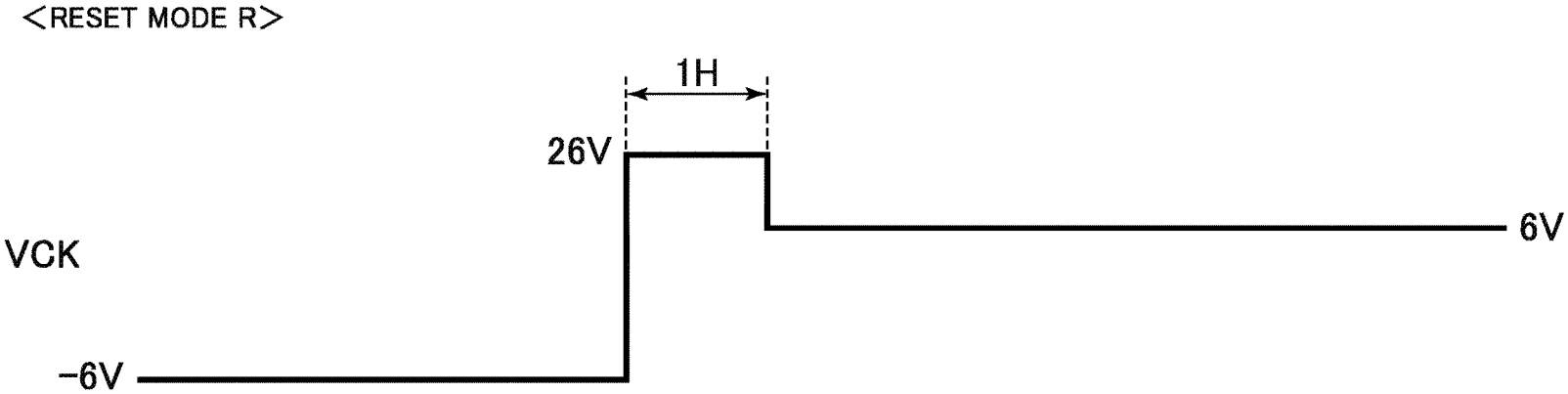
FIG. 14 is a timing chart showing a signal supplied in the reset mode.

FIG. 14 is a timing chart showing a signal supplied in the reset mode. FIG. 14 shows the switching portion of a voltage VCK applied to one selection signal line 62 in the reset mode.

When amorphous silicon, for example, is used as the switching elements 63 included in the selection circuits 6, the amorphous silicon may degrade with the accumulation of the use period of the liquid crystal display apparatus 1 and thus the threshold voltage of the switching elements 63 may gradually increase. Hence, the high-level voltage of a voltage VCK applied to the selection signal lines 62 may be set to a relatively low value, e.g., on the order of +6 V. In this case, it may take time for the voltage VCK applied to the selection signal lines 62 to transition from the low-level voltage to the high-level voltage.

In view of this, in the present embodiment, as shown in FIG. 14, in the reset mode, the scanning signal drive circuit 211 temporarily switches the voltage applied to the selection signal line 62 from a low-level voltage (e.g., −6 V) to a higher voltage (+26 V) than a high-level voltage (+6 V), and then, switches the voltage to the high-level voltage after a lapse of 1H, for example. By this, the switching element 63 is promptly switched from a high-impedance state Z to a state of outputting a low-level voltage, achieving an improvement in display quality.

Exemplary display apparatuses described with the above various embodiments mainly include following configurations.

In one general aspect, the instant application describes a display apparatus includes an image display region having pixels sectioned by scanning signal lines and video signal lines; scanning connecting lines connected to the scanning signal lines, the scanning signal lines being connected to one of the scanning connecting lines; thin film transistors interposed between the scanning signal lines and the scanning connecting lines, a source electrode and a drain electrode of each of the thin film transistors being connected to a corresponding one of the scanning signal lines and a corresponding one of the scanning connecting lines; selection signal lines connected to gate electrodes of the thin film transistors, the thin film transistors connected to different ones of the scanning connecting lines being connected to one of the selection signal lines; and a scanning signal drive circuit connected to the scanning connecting lines and the selection signal lines. The scanning signal drive circuit performs a normal scanning mode in which pulse signals are supplied in turn to plural ones of the scanning connecting lines connected to the one of the selection signal lines, during a selection period in which a gate-on voltage is applied to one of the selection signal lines, gate-off voltages are applied to other ones of the selection signal lines, and in the normal scanning mode, a fall timing of the gate-on voltage differs from a fall timing of a last one of the pulse signals supplied to the scanning connecting lines during the selection period.

The above general aspect may include one or more of the following features.

The last one of the pulse signals may fall before the gate-on voltage falls.

The scanning signal drive circuit may generate a first clock signal and a second clock signal having a same cycle as the first clock signal and having rise and fall timings different from those of the first clock signal; and may control rise and fall of the gate-on voltage based on the first clock signal, and may control rise and fall of the pulse signals based on the second clock signal.

The selection signal lines may include a first selection signal line and a second selection signal line. The scanning signal drive circuit may switch, during a vertical scanning retrace period, between the normal scanning mode and a reset mode in which a gate-off voltage is applied to one of the selection signal lines, gate-on voltages are applied to other ones of the selection signal lines, and low-level voltages are applied to the scanning connecting lines; and may make a timing at which a voltage applied to the first selection signal line is switched different from a timing at which a voltage applied to the second selection signal line is switched, when the scanning signal drive circuit switches between the normal scanning mode and the reset mode.

When the scanning signal drive circuit switches between the normal scanning mode and the reset mode, the scanning signal drive circuit may make timings at which the voltages applied to the plurality of selection signal lines are switched different from each other.

The scanning connecting lines, the thin film transistors, and the selection signal lines may be provided on both sides of the scanning signal lines. The scanning signal drive circuit: may perform the normal scanning mode on one of the sides and performs the reset mode on an other one of the sides; and may apply the gate-on voltage to each of the selection signal lines connected to the thin film transistors connected to the one of the sides of the scanning signal lines, and applies the gate-off voltage to each of the selection signal lines connected to the thin film transistors connected to the other one of the sides of the scanning signal lines.

The scanning connecting lines, the thin film transistors, and the selection signal lines may be provided on both sides of the scanning signal lines. The scanning signal drive circuit: may switch, during the vertical scanning retrace period, between a state in which the normal scanning mode is performed on one of the sides and the reset mode is performed on an other one of the sides, and a state in which the reset mode is performed on the one of the sides and the normal scanning mode is performed on the other one of the sides; may switch voltages applied to the plurality of selection signal lines on the one of the sides in turn during a first period included in the vertical scanning retrace period; and may switch voltages applied to the plurality of selection signal lines on the other one of the sides in turn during a second period included in the vertical scanning retrace period. The first period may not overlap the second period.

The scanning signal drive circuit may perform a reset mode in which a gate-off voltage is applied to one of the plurality of selection signal lines, gate-on voltages are applied to other ones of the selection signal lines, and low-level voltages are applied to the scanning connecting lines. In the reset mode, a voltage applied to each of the selection signal lines may be switched from the gate-off voltage to a higher voltage than the gate-on voltage and may be then switched to the gate-on voltage.

In one general aspect, the instant application describes a display apparatus includes an image display region having pixels sectioned by scanning signal lines and video signal lines; scanning connecting lines connected to the scanning signal lines, the scanning signal lines being connected to one of the scanning connecting lines; thin film transistors interposed between the scanning signal lines and the scanning connecting lines, a source electrode and a drain electrode of each of the thin film transistors being connected to a corresponding one of the scanning signal lines and a corresponding one of the scanning connecting lines; selection signal lines connected to gate electrodes of the thin film transistors, the thin film transistors connected to different ones of the scanning connecting lines being connected to one of the selection signal lines; and a scanning signal drive circuit connected to the scanning connecting lines and the selection signal lines. The scanning signal drive circuit performs a normal scanning mode in which pulse signals are supplied in turn to plural ones of the scanning connecting lines connected to the one of the selection signal lines, during a selection period in which a gate-on voltage is applied to one of the selection signal lines, gate-off voltages are applied to other ones of the selection signal lines, and in the normal scanning mode, a rise timing of the gate-on voltage differs from a rise timing of a first one of the pulse signals supplied to the plurality of scanning connecting lines during the selection period.

The above general aspect may include one or more of the following features.

The first one of the pulse signals may rise after the gate-on voltage rises.

The scanning signal drive circuit: may generate a first clock signal and a second clock signal having a same cycle as the first clock signal and having rise and fall timings different from those of the first clock signal; and may control rise and fall of the gate-on voltage based on the first clock signal, and controls rise and fall of the pulse signals based on the second clock signal.

In one general aspect, the instant application describes a display apparatus includes an image display region having pixels sectioned by scanning signal lines and video signal lines; scanning connecting lines connected to the scanning signal lines, the scanning signal lines being connected to one of the scanning connecting lines; thin film transistors interposed between the scanning signal lines and the scanning connecting lines, a source electrode and a drain electrode of each of the thin film transistors being connected to a corresponding one of the scanning signal lines and a corresponding one of the scanning connecting lines; selection signal lines connected to gate electrodes of the thin film transistors, the thin film transistors connected to different ones of the scanning connecting lines being connected to one of the selection signal lines; and a scanning signal drive circuit connected to the scanning connecting lines and the selection signal lines. The scanning signal drive circuit performs a normal scanning mode in which pulse signals are supplied in turn to plural ones of the scanning connecting lines connected to the one of the selection signal lines, during a selection period in which a gate-on voltage is applied to one of the selection signal lines, gate-off voltages are applied to other ones of the selection signal lines, and in the normal scanning mode, a fall timing of the gate-on voltage differs from a fall timing of a last one of the pulse signals supplied to the scanning connecting lines during the selection period.

The above general aspect may include one or more of the following features.

The last one of the pulse signals may fall before the gate-on voltage falls.

The scanning signal drive circuit: may generate a first clock signal and a second clock signal having a same cycle as the first clock signal and having rise and fall timings different from those of the first clock signal; and may control rise and fall of the gate-on voltage based on the first clock signal, and controls rise and fall of the pulse signals based on the second clock signal.

The selection signal lines may include a first selection signal line and a second selection signal line, and the scanning signal drive circuit: may switch, during a vertical scanning retrace period, between the normal scanning mode and a reset mode in which a gate-off voltage is applied to one of the selection signal lines, gate-on voltages are applied to other ones of the selection signal lines, and low-level voltages are applied to the scanning connecting lines; and may make a timing at which a voltage applied to the first selection signal line is switched different from a timing at which a voltage applied to the second selection signal line is switched, when the scanning signal drive circuit switches between the normal scanning mode and the reset mode.

When the scanning signal drive circuit switches between the normal scanning mode and the reset mode, the scanning signal drive circuit may make timings at which the voltages applied to the plurality of selection signal lines are switched different from each other.

The scanning connecting lines, the thin film transistors, and the selection signal lines may be provided on both sides of the scanning signal lines, and the scanning signal drive circuit: may performs the normal scanning mode on one of the sides and performs the reset mode on an other one of the sides; and may apply the gate-on voltage to each of the selection signal lines connected to the thin film transistors connected to the one of the sides of the scanning signal lines, and may apply the gate-off voltage to each of the selection signal lines connected to the thin film transistors connected to the other one of the sides of the scanning signal lines.

The scanning connecting lines, the thin film transistors, and the selection signal lines may be provided on both sides of the scanning signal lines, and the scanning signal drive circuit may switch, during the vertical scanning retrace period, between a state in which the normal scanning mode is performed on one of the sides and the reset mode is performed on an other one of the sides, and a state in which the reset mode is performed on the one of the sides and the normal scanning mode is performed on the other one of the sides, may switch voltages applied to the plurality of selection signal lines on the one of the sides in turn during a first period included in the vertical scanning retrace period; and may switch voltages applied to the plurality of selection signal lines on the other one of the sides in turn during a second period included in the vertical scanning retrace period, and the first period may not overlap the second period.

The scanning signal drive circuit may perform a reset mode in which a gate-off voltage is applied to one of the plurality of selection signal lines, gate-on voltages are applied to other ones of the selection signal lines, and low-level voltages are applied to the scanning connecting lines, and in the reset mode, a voltage may applied to each of the selection signal lines may be switched from the gate-off voltage to a higher voltage than the gate-on voltage and is then switched to the gate-on voltage.

In another general aspect, the instant application describes a display apparatus includes an image display region having pixels sectioned by scanning signal lines and video signal lines; scanning connecting lines connected to the scanning signal lines, the scanning signal lines being connected to one of the scanning connecting lines; thin film transistors interposed between the scanning signal lines and the scanning connecting lines, a source electrode and a drain electrode of each of the thin film transistors being connected to a corresponding one of the scanning signal lines and a corresponding one of the scanning connecting lines; selection signal lines connected to gate electrodes of the thin film transistors, the thin film transistors connected to different ones of the scanning connecting lines being connected to one of the selection signal lines; and a scanning signal drive circuit connected to the scanning connecting lines and the selection signal lines. The scanning signal drive circuit performs a normal scanning mode in which pulse signals are supplied in turn to plural ones of the scanning connecting lines connected to the one of the selection signal lines, during a selection period in which a gate-on voltage is applied to one of the selection signal lines, gate-off voltages are applied to other ones of the selection signal lines, and in the normal scanning mode, a rise timing of the gate-on voltage differs from a rise timing of a first one of the pulse signals supplied to the plurality of scanning connecting lines during the selection period.

The first one of the pulse signals may rise after the gate-on voltage rises.

The scanning signal drive circuit may generate a first clock signal and a second clock signal having a same cycle as the first clock signal and having rise and fall timings different from those of the first clock signal; and control rise and fall of the gate-on voltage based on the first clock signal, and controls rise and fall of the pulse signals based on the second clock signal.

Note that a specific configuration embodied in the above-described embodiment is exemplified to describe the present invention and thus the technical scope of the present invention is not limited to the specific configuration. Those skilled in the art may modify or optimize the content disclosed in the above-described embodiment, as appropriate. For example, the disposition positions, numbers, shapes, and the like, of the members may be arbitrarily changed if necessary.

For example, the drive control of the scanning signal lines X by the scanning signal drive circuit 211 described above is not limited to be used on a liquid crystal display apparatus, and may be used on display apparatuses such as an organic EL display apparatus.

As used herein, the phrase "at least one of" preceding a series of items, with the term "and" or "or" to separate any of the items, modifies the list as a whole, rather than each member of the list (e.g., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f), unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa.

Headings and subheadings, if any, are used for convenience only and do not limit the subject disclosure.

What is claimed is:

1. A display apparatus comprising:

an image display region having a plurality of pixels sectioned by a plurality of scanning signal lines and a plurality of video signal lines; and outside regions disposed outside of the image display region, the outside region comprising:

a plurality of scanning connecting lines connected to the scanning signal lines, plural ones of the scanning signal lines being connected to one of the scanning connecting lines;

a plurality of thin film transistors including first thin film transistors, a source electrode and a drain electrode of each of the first thin film transistors being connected to a corresponding one of the scanning signal lines and a corresponding one of the scanning connecting lines;

a plurality of selection signal lines connected to gate electrodes of the first thin film transistors, plural ones of the first thin film transistors connected to different ones of the scanning connecting lines being connected to one of the selection signal lines; and a scanning signal drive circuit connected to the scanning connecting lines and the selection signal lines, wherein the scanning signal drive circuit performs a normal scanning mode in which pulse signals are supplied in turn to plural ones of the plurality of scanning connecting lines connected to the one of the plurality of selection signal lines, during a selection period in which a gate-on voltage is applied to one of the plurality of selection signal lines, gate-off voltages are applied to other ones of the plurality of selection signal lines, and in the normal scanning mode, a rise timing of the gate-on voltage differs from a rise timing of a first one of the pulse signals supplied to the plural ones of the plurality of scanning connecting lines during the selection period.

2. The display apparatus according to claim 1, wherein the first one of the pulse signals rises after the gate-on voltage rises.

3. The display apparatus according to claim 1, wherein the scanning signal drive circuit:

generates a first clock signal and a second clock signal having a same cycle as the first clock signal and having rise and fall timings different from those of the first clock signal; and controls rise and fall of the gate-on voltage based on the first clock signal, and controls rise and fall of the pulse signals based on the second clock signal.

* * * * *